US011206876B2

(12) United States Patent
Pratt

(10) Patent No.: US 11,206,876 B2
(45) Date of Patent: Dec. 28, 2021

(54) WOMEN'S CAPSULE DRESS

(71) Applicant: Morph Clothing, LLC, Charleston, SC (US)

(72) Inventor: Cristy Pratt, Mount Pleasant, SC (US)

(73) Assignee: MORPH CLOTHING LLC, Mount Pleasant, SC (US)

( * ) Notice: Subject to any disclaimer, the term of this patent is extended or adjusted under 35 U.S.C. 154(b) by 0 days.

(21) Appl. No.: 16/297,150

(22) Filed: Mar. 8, 2019

(65) Prior Publication Data

US 2020/0297046 A1 Sep. 24, 2020

Related U.S. Application Data

(60) Provisional application No. 62/644,069, filed on Mar. 16, 2018.

(51) Int. Cl.
*A41D 1/22* (2018.01)
*A41D 15/04* (2006.01)
*A41D 27/10* (2006.01)

(52) U.S. Cl.
CPC ..... *A41D 1/22* (2013.01); *A41D 15/04* (2013.01); *A41D 27/10* (2013.01)

(58) Field of Classification Search
CPC ..... A41D 1/22; A41D 15/04; A41D 15/00; A41D 15/007; A41D 15/005; A41D 15/02; A41D 1/06; A41D 3/08
USPC ..... 2/72, 243.1, 69, 105, 106, 85, DIG. 2; D2/756, 774, 775
See application file for complete search history.

(56) References Cited

U.S. PATENT DOCUMENTS 3,877,078 A * 4/1975 Tepper ..... A41D 1/22 2/74
4,055,854 A * 11/1977 Jones ..... A41D 7/00 2/105
2006/0137075 A1* 6/2006 Gheneva ..... A41D 1/06 2/227
2008/0047044 A1* 2/2008 Jones ..... A41D 27/10 2/84
2008/0168590 A1* 7/2008 Bousquet ..... A41D 1/04 2/74
2009/0007309 A1* 1/2009 Yamashita ..... D04B 1/24 2/69
2009/0282598 A1* 11/2009 Sumar ..... A41D 1/22 2/67
2009/0300817 A1* 12/2009 Fata ..... A41D 1/22 2/74
2010/0071110 A1* 3/2010 Stevens ..... A45F 3/14 2/69
2011/0307992 A1* 12/2011 Martinson ..... A41D 15/00 2/69
2013/0239286 A1* 9/2013 Gray ..... A41D 15/00 2/69
2014/0157478 A1* 6/2014 Van De Velde ..... A41D 15/00 2/69
2014/0298563 A1* 10/2014 Cavero ..... A41D 1/14 2/74

(Continued)

*Primary Examiner* — Gloria M Hale
(74) *Attorney, Agent, or Firm* — Gregory Finch; Finch Paolino, LLC

(57) ABSTRACT

A dress pattern and dress that may be worn in different configurations. The dress as described herein may be worn in the different configurations either as a primary garment or as a garment over, under, or otherwise in conjunction with a wearer's primary clothing.

10 Claims, 25 Drawing Sheets

(56) References Cited

U.S. PATENT DOCUMENTS

| | | | | |
|---|---|---|---|---|
| 2015/0089712 | A1* | 4/2015 | Gamble | A41D 3/08 2/88 |
| 2015/0208734 | A1* | 7/2015 | Callahan | A41D 27/02 450/30 |
| 2018/0116307 | A1* | 5/2018 | Barton | A41D 1/215 |

* cited by examiner

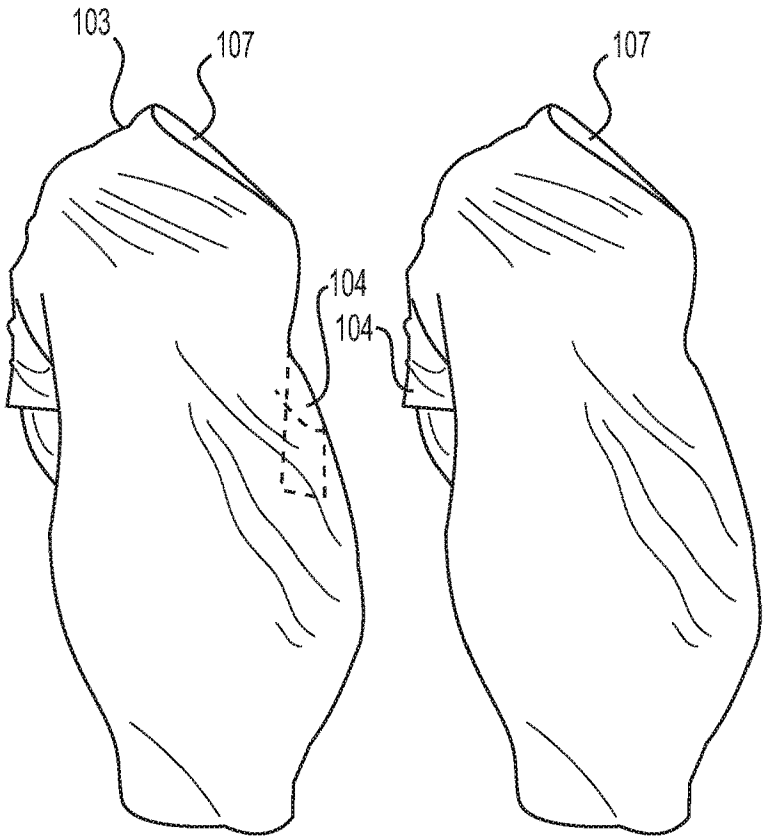
FIG. 5D
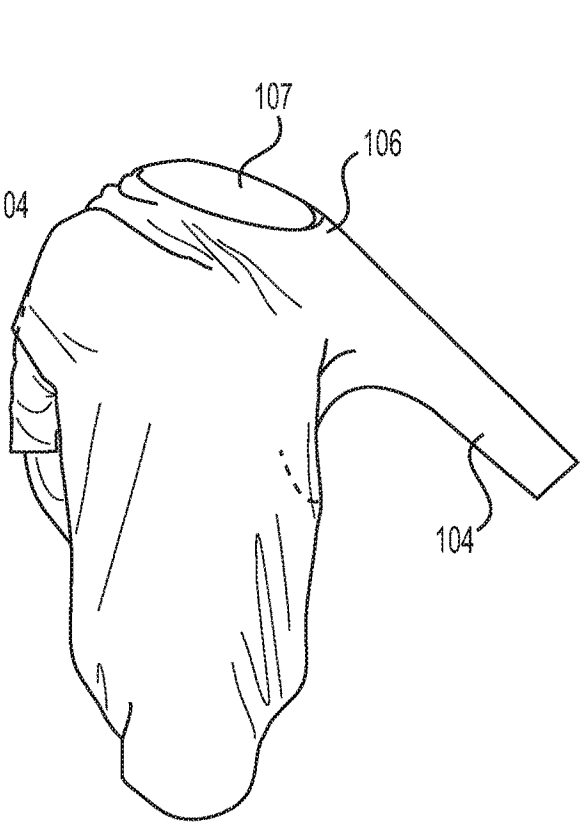
FIG. 5C
FIG. 5B
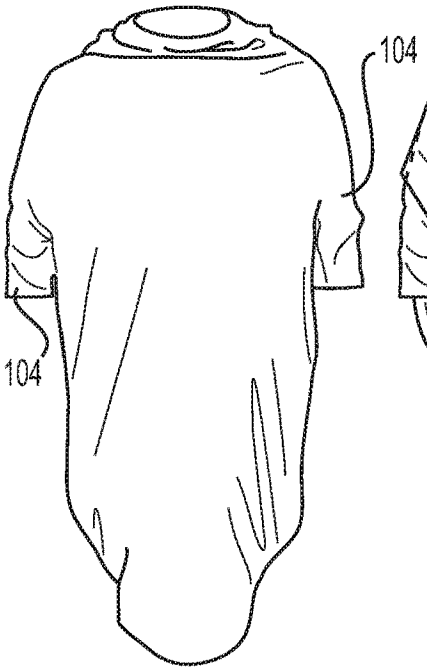
FIG. 5A

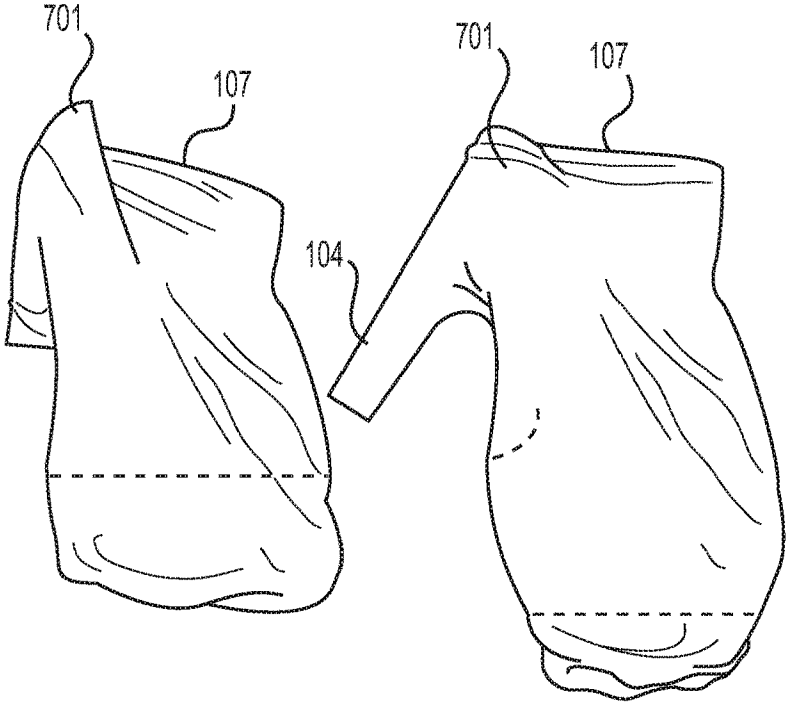
FIG. 9A
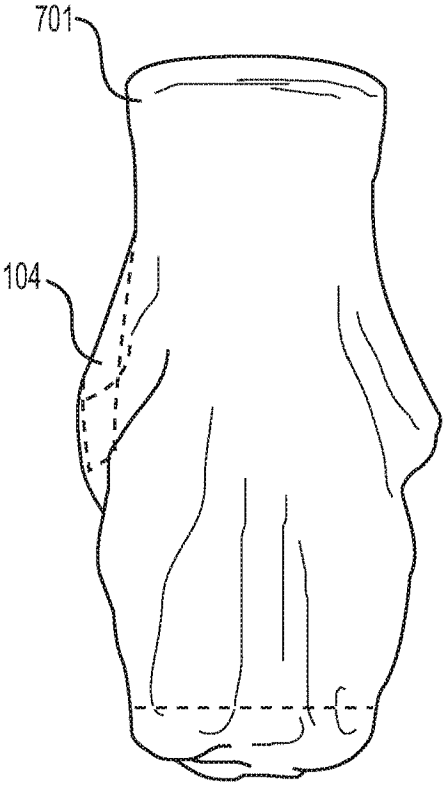
FIG. 9B
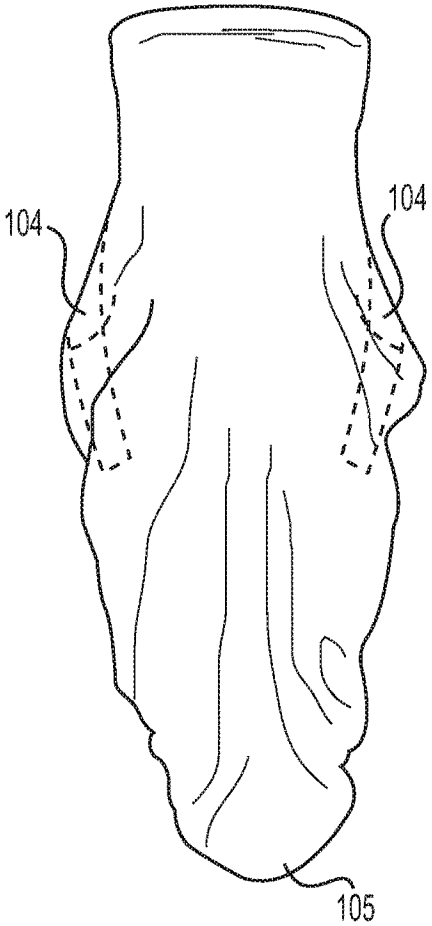
FIG. 9C
FIG. 9D

WOMEN'S CAPSULE DRESS

BACKGROUND

Field of the Invention

The invention generally relates to a dress that is capable of being worn in multiple manners, and more specifically to a dress that is convertible between casual and related attire to cocktail, semi-formal, and formal attire at user's discretion.

Background Information

Modem lifestyles require wardrobe flexibility, especially for women who are on the go. Pressure to reduce waste and extraneous clothing competes with the need of an increasingly busy and mobile woman to have multiple options for apparel, depending upon the situation. Formal and semi-formal events often require different attire than casual and semi-casual settings. While some women may opt to have a larger wardrobe to accommodate the various attire needs that she encounters, many women choose to reduce the size of their wardrobe and seek to avoid sacrificing flexibility in their attire choices while doing so.

There is a void in the art for women's garments which can replace multiple wardrobe items and fulfill the need to accommodate changing styles as well as convert to garments which can be worn to a wide range of social settings and events. Such a garment can serve as a single garment for a change of attire when needed.

SUMMARY OF THE INVENTION

The present invention relates to a women's garment which may be worn in various manners to accommodate various social and other settings. The invention provides a wide range of wardrobe options quickly and easily from a single garment. The garment may be worn as various forms of dresses and skirts that drape on a user in various manners. The garment may be worn to include skirt of various lengths, along with various configurations to drape on and over the wearer. The garment is easily worn and converted, in most cases without need for removal of the garment to change the configuration. As a result, the garment that is the subject of this invention is versatile, portable, and easily used.

BRIEF DESCRIPTION OF THE DRAWINGS

FIG. 5A shows a view of a configuration change of the present dress invention.

FIG. 5B shows a view of a configuration change of the present dress invention.

FIG. 5C shows a view of a configuration change of the present dress invention.

FIG. 5D shows a view of a configuration change of the present dress invention.

FIG. 9A shows a view of a configuration change of the present dress invention.

FIG. 9B shows a view of a configuration change of the present dress invention.

FIG. 9C shows a view of a configuration change of the present dress invention.

FIG. 9D shows a view of a configuration change of the present dress invention.

DETAILED DESCRIPTION OF THE INVENTION

Figure 1:
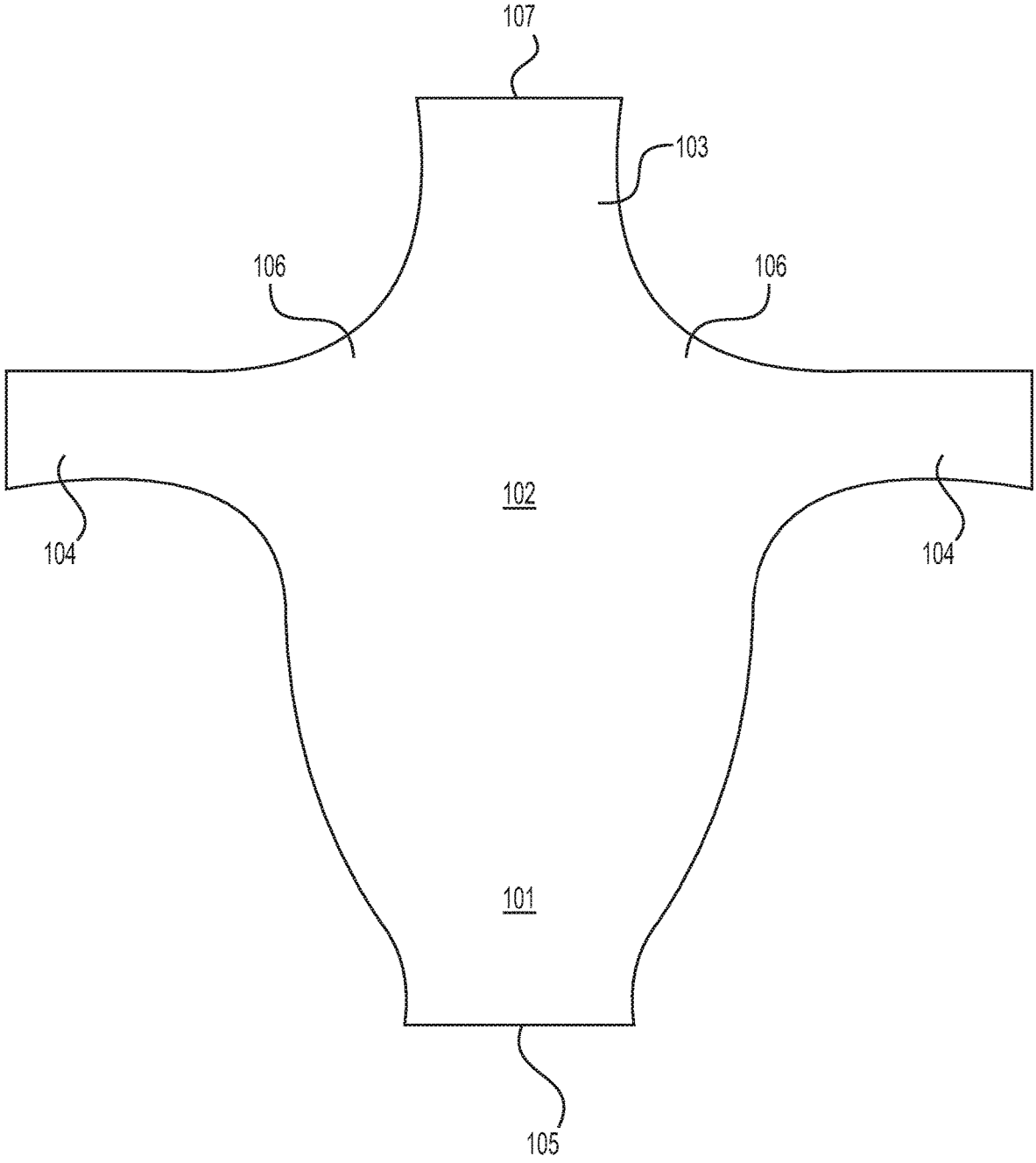
FIG. 1 shows a front plan view of the pattern for a convertible women's garment, showing the dress as patterned in fabric.

The invention is shown in its pattern form in FIG. 1. The pattern 101 is repeated twice and the edges sewn together to form the final dress product. The pattern 101 comprises a body portion 102, a neck portion 103, one or more sleeve portions 104, a hem (bottom) portion 105, one or more shoulder portions 106, and a neck opening 107. The final product when two patterns 101 are sewn together may be worn as shown in FIGS. 2A, 2B, 2C, and 2D and FIGS. 3A, 3B, 3C, and 3D. Transitions between the configurations contemplated herein is described in detail below, and it will be understood that there are other configurations that are not shown that may be utilized to wear the present invention. Such configurations are contemplated within the scope of the present invention. The fabric chosen for the garment may be chosen from a variety of well-known textiles having some elasticity so that the garment may be reconfigured as described herein. It will also be understood that the same ability to be reconfigured as described in the present invention may be achieved by using well-known techniques such as the use of elastic or other materials in the portions of the garment that require the ability to stretch and contract, such as in the neck opening 107 and the hemline 105. Such modification are contemplated within the spirit and scope of the invention, including strapless and related configurations.

Figure 2D:
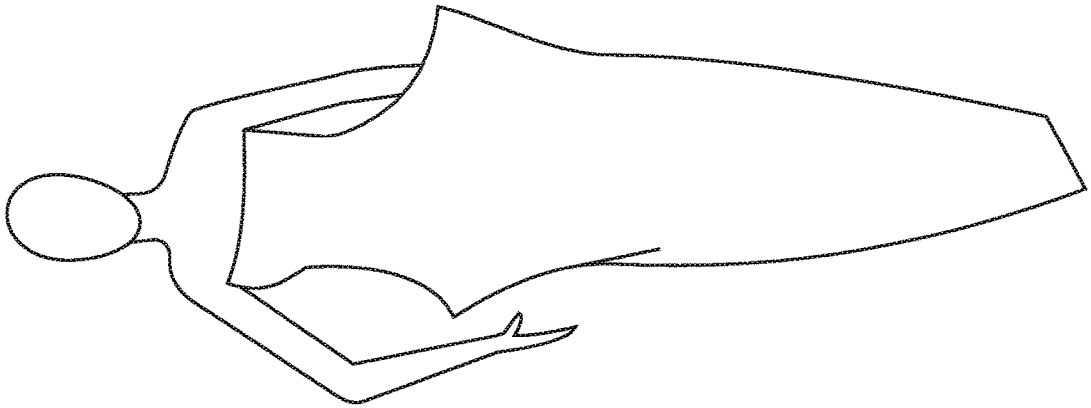
FIG. 2D shows a view of a configuration change of the present dress invention.
Figure 2C:
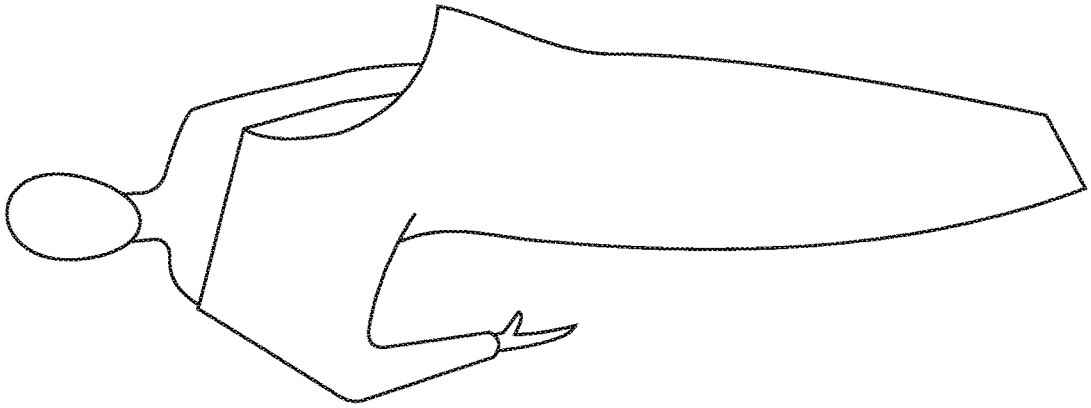
FIG. 2C shows a view of a configuration change of the present dress invention.
Figure 2B:
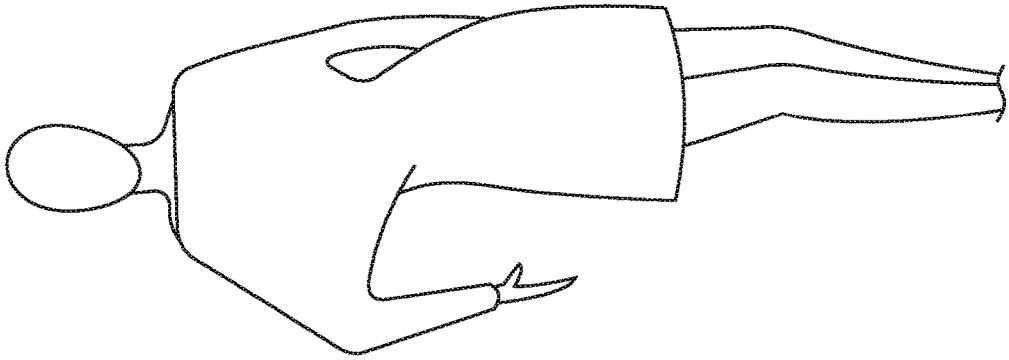
FIG. 2B shows a view of a configuration change of the present dress invention.
Figure 2A:
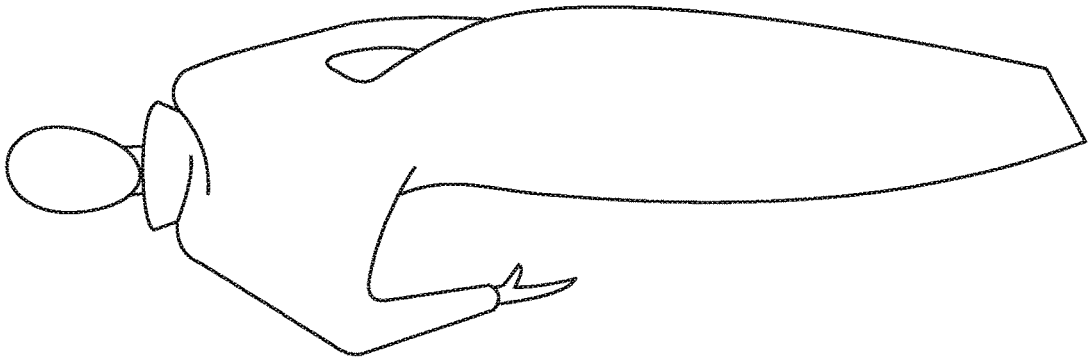
FIG. 2A shows a view of a configuration change of the present dress invention.
Figures 3A, 3B, 3C, 3D:
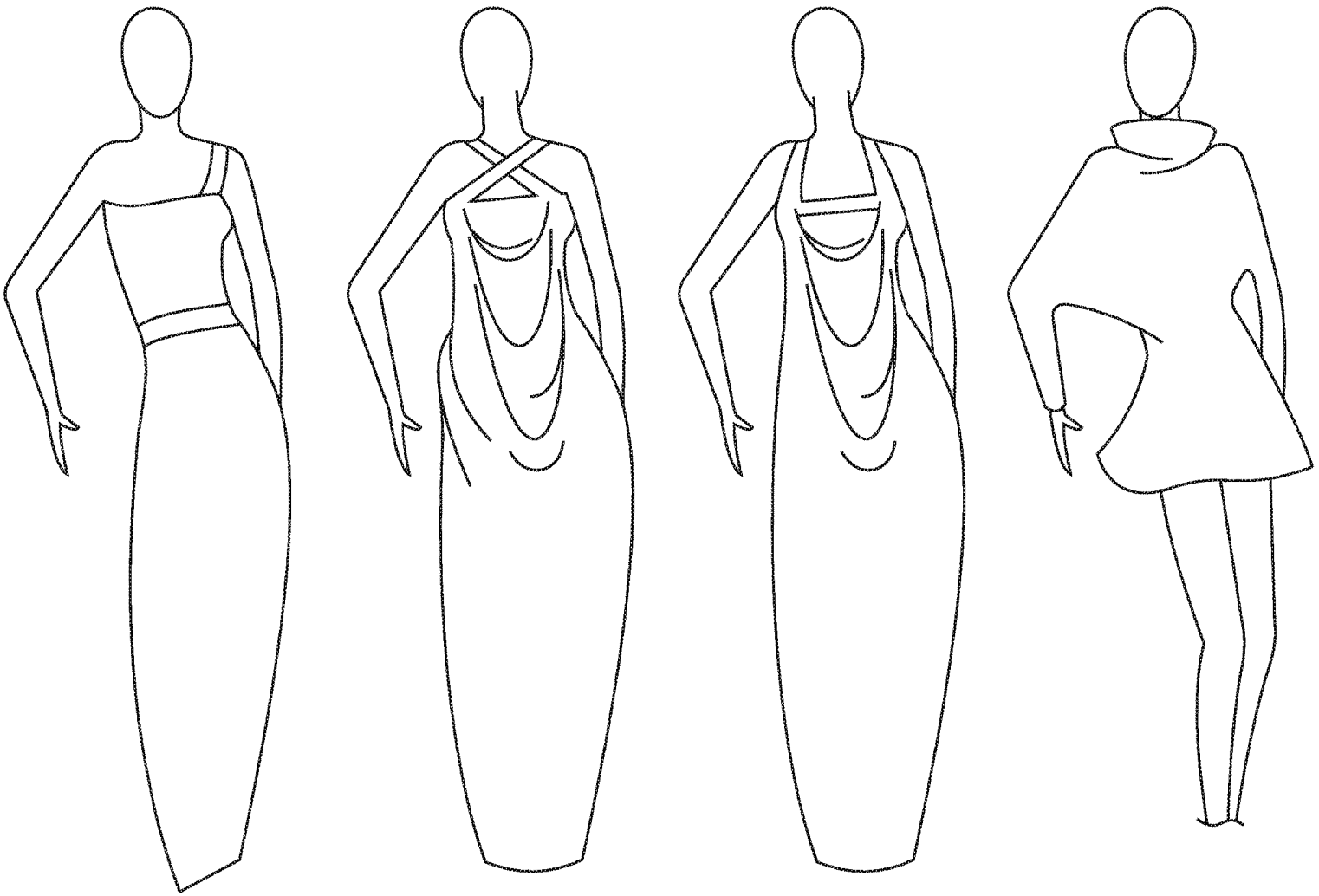
FIG. 3A shows a view of a configuration change of the present dress invention.
FIG. 3B shows a view of a configuration change of the present dress invention.
FIG. 3C shows a view of a configuration change of the present dress invention.
FIG. 3D shows a view of a configuration change of the present dress invention.

From an initial configuration FIG. 2A with the entirety of the garment exposed (the sleeves are worn full length, the neckline is up covering both shoulders of the wearer, and the skirt portion is full-length).

It will also be understood that the length of the garment may be adjusted, and each of the configurations shown in FIGS. 2A-2D and 3A-3D may be worn with the hem positioned at varying heights.

The sleeves 104 may be worn either as sleeves for the garment of varying lengths, or may be hidden by inverting the sleeves 104 (as described below) within the body portion 102 of the garment.

In describing the invention, ties and knots are shown for illustration. It will be understood that the knots as shown are not limiting, and various knots and ties may be used by a user to achieve a desired aesthetic.

Figure 4A:
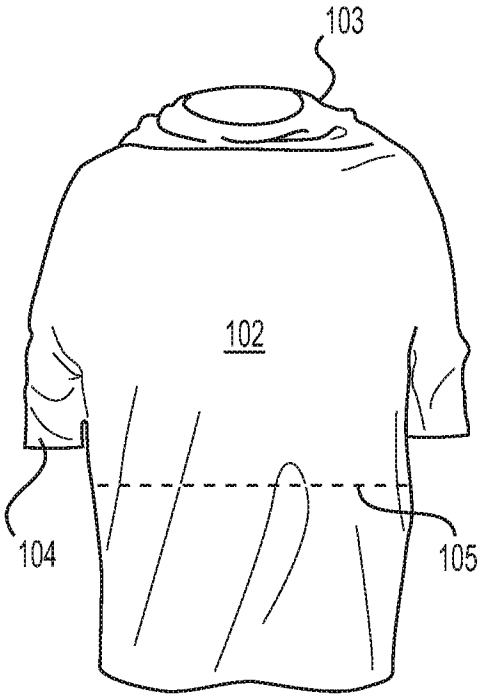
FIG. 4A shows a view of a configuration change of the present dress invention.
Figure 4B:
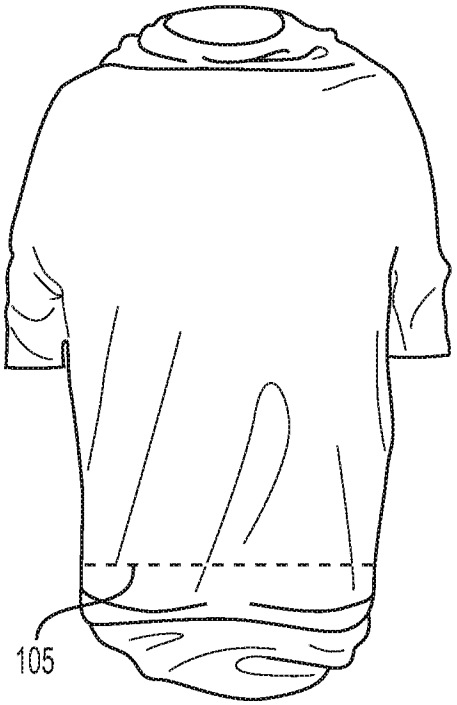
FIG. 4B shows a view of a configuration change of the present dress invention.
Figure 4C:
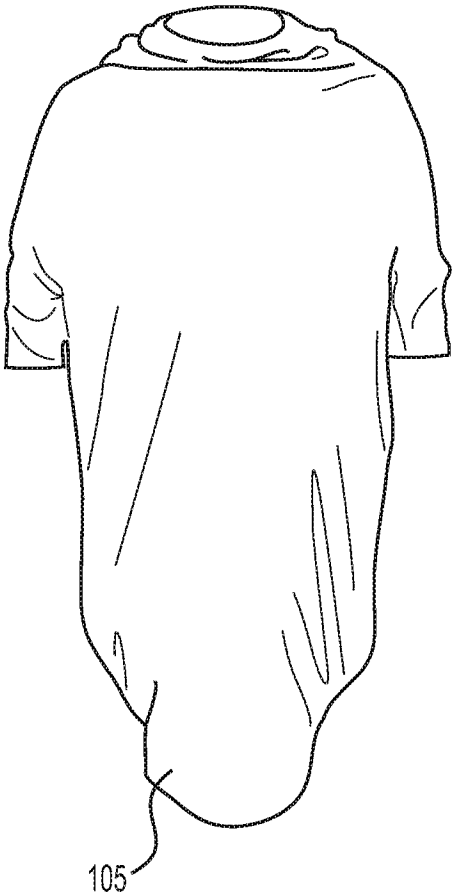
FIG. 4C shows a view of a configuration change of the present dress invention.

FIGS. 4A-4C shows a conversion of the garment by increasing the length of the hemline. FIG. 4A shows the garment with sleeves 104 partially inverted (tucked back inside of the sleeve), and the hemline 105 disposed underneath the body 102 of the garment. The user pulls the hemline 105 down from within the garment to a desired length, either partially lengthened as shown in FIG. 4B or full-length as shown in FIG. 4C. The configuration of FIG. 4C with the sleeves 104 being pulled to full-length is shown in FIG. 2A.

FIG. 5 shows a conversion of the garment from the full-length, shortened-sleeve configuration shown in FIG. 4C. The sleeves 104 are pulled to full-length from being inverted, and the neck portion 106 being pulled in the direction of a sleeve 104 on a desired side of the garment. The user withdraws an arm from within the garment and out through the neck opening 107 such that the shoulder portion 106 is now disposed under the arm of the user, leaving a user's arm exposed. The sleeve 104 located on the same side of the garment with the user's exposed arm is inverted (FIG. 5B) so that one side of the garment is off-the shoulder and under the arm of the user with the sleeve 104 on that side of the garment inverted into the garment and hidden from view. The length of the sleeve 104 on the side opposite the exposed arm may be adjusted as the user desires.

Figure 6B:
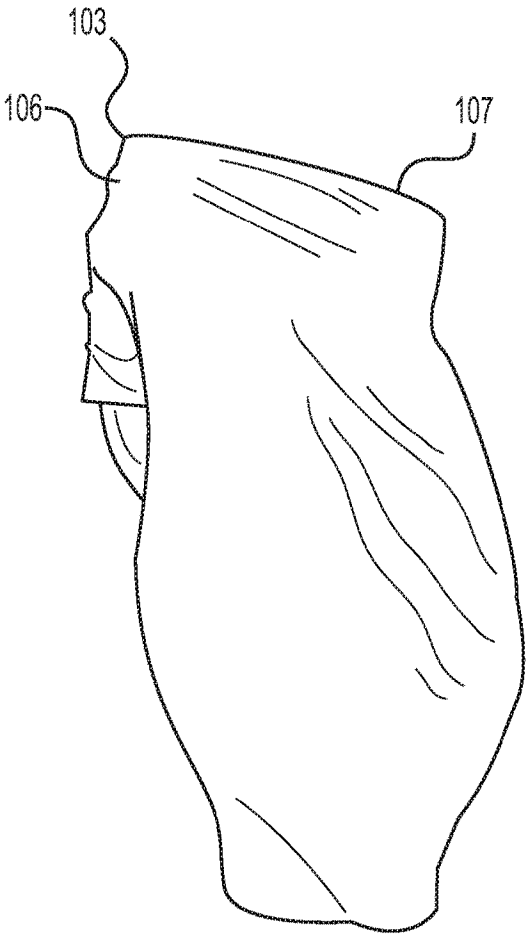
FIG. 6B shows a view of a configuration change of the present dress invention.
Figure 6A:
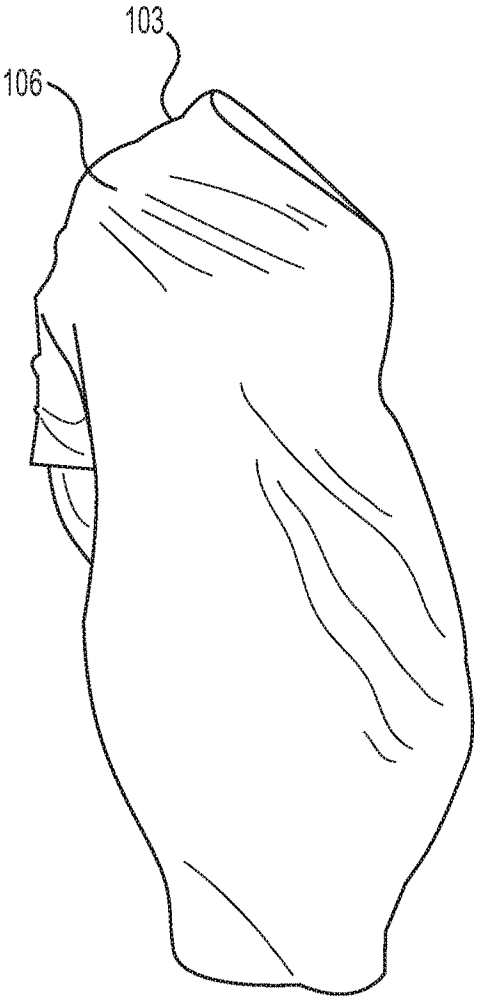
FIG. 6A shows a view of a configuration change of the present dress invention.

FIGS. 6A and 6B shows a conversion of the garment from the configuration shown in FIGS. 5C and 2C by moving the shoulder portion 106 and neck portion 103 down off the shoulder of the user so that the garment is now off-the-shoulder on both sides of the garment as shown in FIGS. 6A and 2C.

Figure 7C:
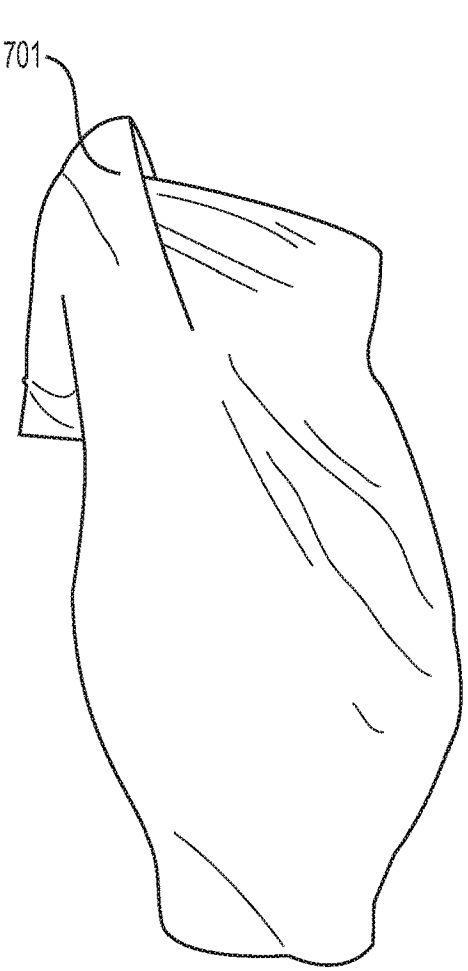
FIG. 7C shows a view of a configuration change of the present dress invention.
Figure 7B:
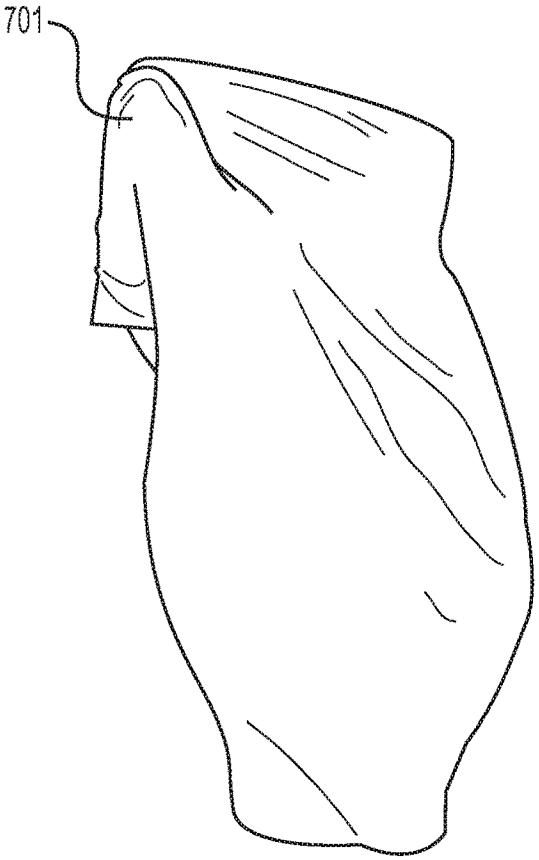
FIG. 7B shows a view of a configuration change of the present dress invention.
Figure 7A:
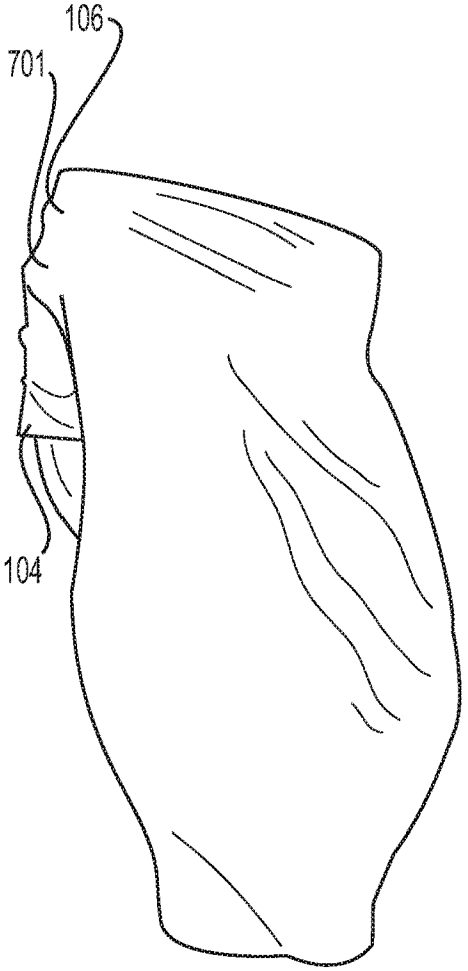
FIG. 7A shows a view of a configuration change of the present dress invention.

FIGS. 7A-7C shows a conversion of the garment from the configuration shown in FIG. 7A to an alternative over-the-shoulder configuration on the side opposite the side of the garment with the user's arm exposed. The upper sleeve portion 701 on the side opposite the user's exposed arm is drawn up and over the shoulder portion 106 such that the upper sleeve portion 107 is now disposed over the user's shoulder, creating a new look (FIG. 7C) from the configuration shown in FIG. 7A.

Figure 8C:
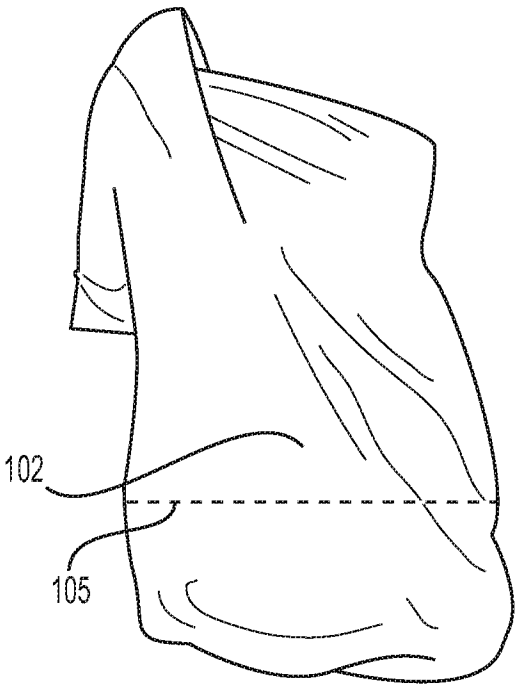
FIG. 8C shows a view of a configuration change of the present dress invention.
Figure 8B:
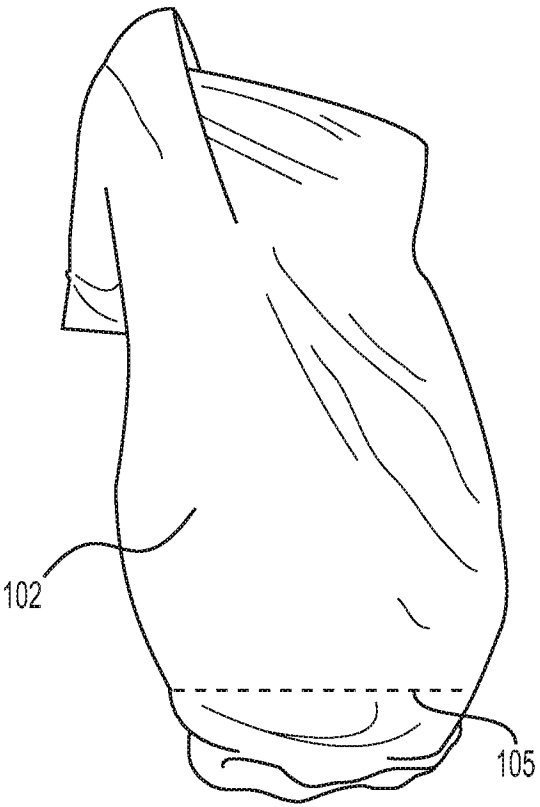
FIG. 8B shows a view of a configuration change of the present dress invention.
Figure 8A:
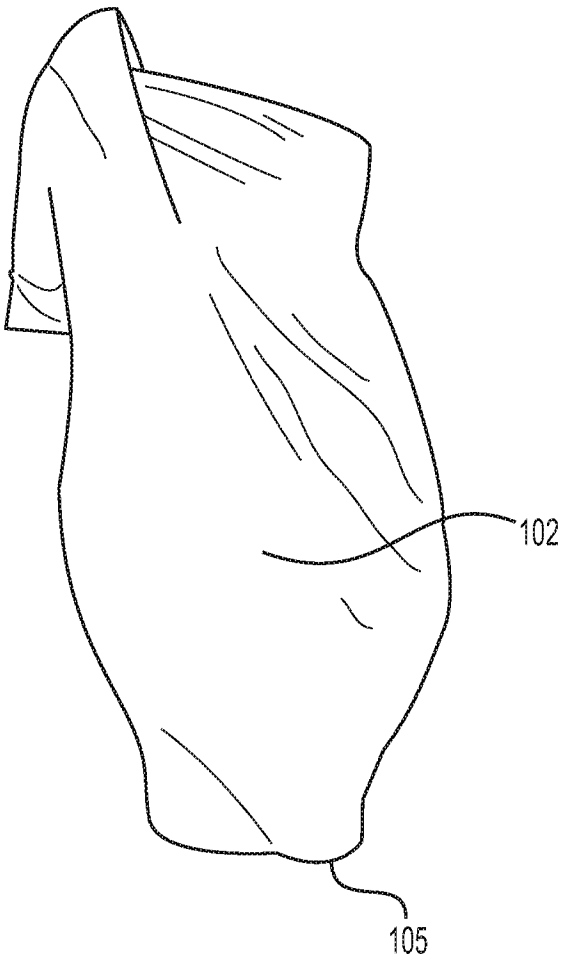
FIG. 8A shows a view of a configuration change of the present dress invention.

FIGS. 8A-8C shows a conversion of the configuration of the garment as shown in FIG. 8A to a garment with a shorter hemline 105 by inverting the hemline 105 up and over the user's legs so that the hemline 105 is disposed underneath of the body portion 102 of the garment. This results in the garment configuration shown in FIGS. 8B and 8C. As described above, the elasticity of the garment hemline 105 allows the hemline 105 to remain.

Figure 10C:
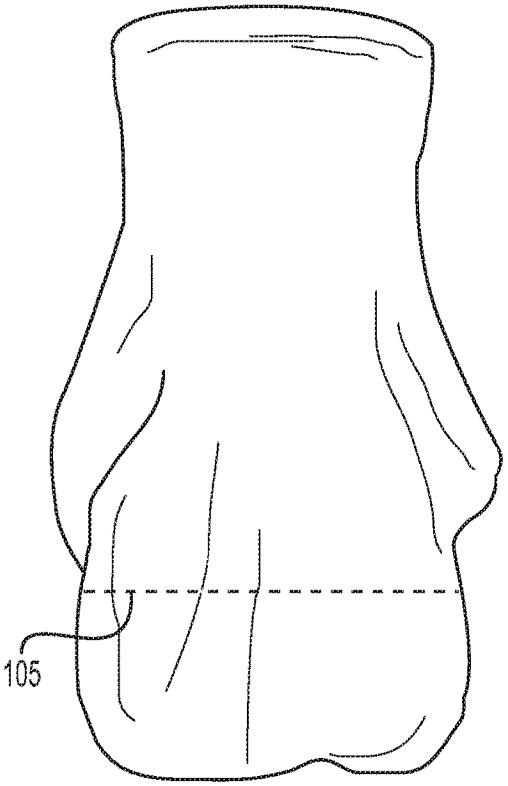
FIG. 10C shows a view of a configuration change of the present dress invention.
Figure 10B:
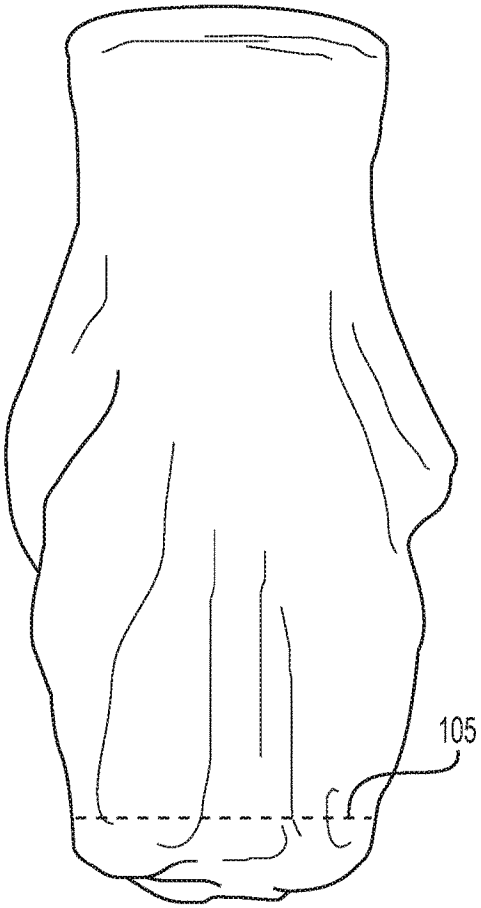
FIG. 10B shows a view of a configuration change of the present dress invention.
Figure 10A:
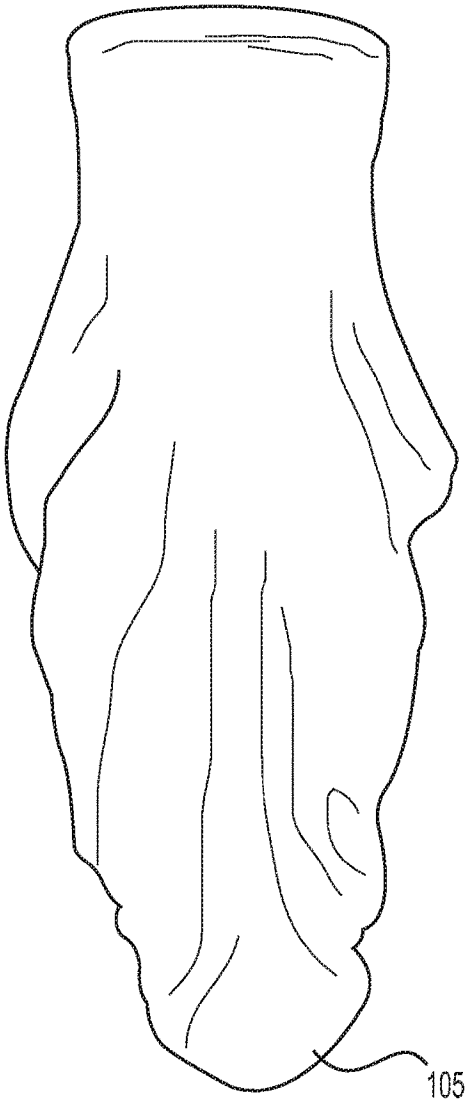
FIG. 10A shows a view of a configuration change of the present dress invention.
Figure 11C:
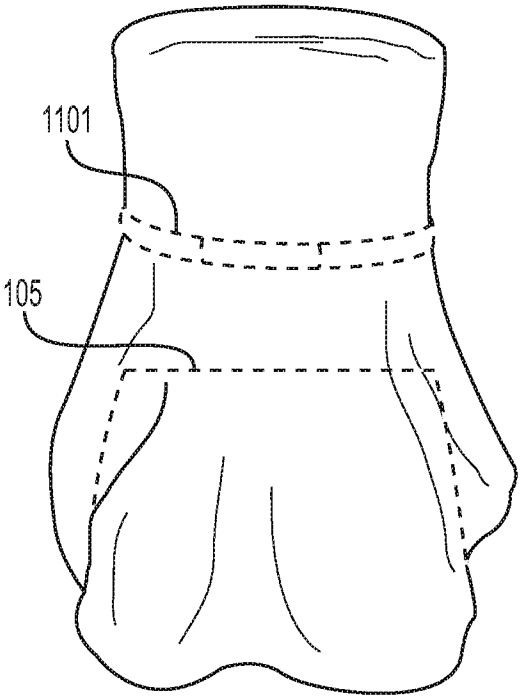
FIG. 11C shows a view of a configuration change of the present dress invention.
Figure 11B:
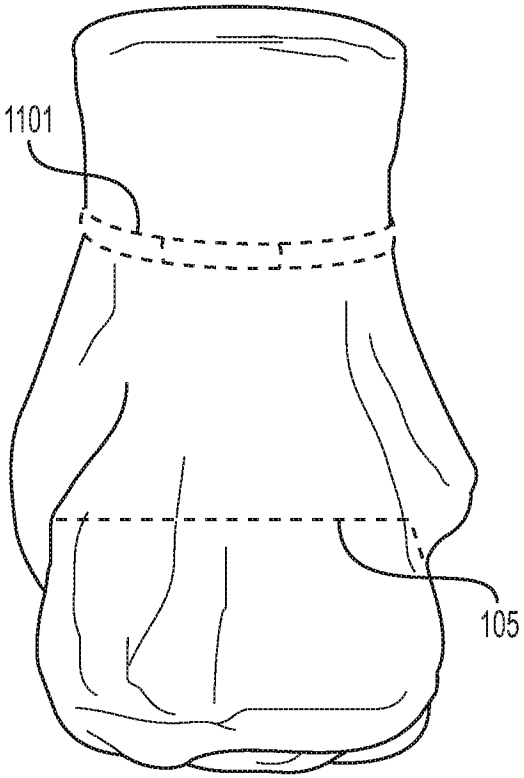
FIG. 11B shows a view of a configuration change of the present dress invention.
Figure 11A:
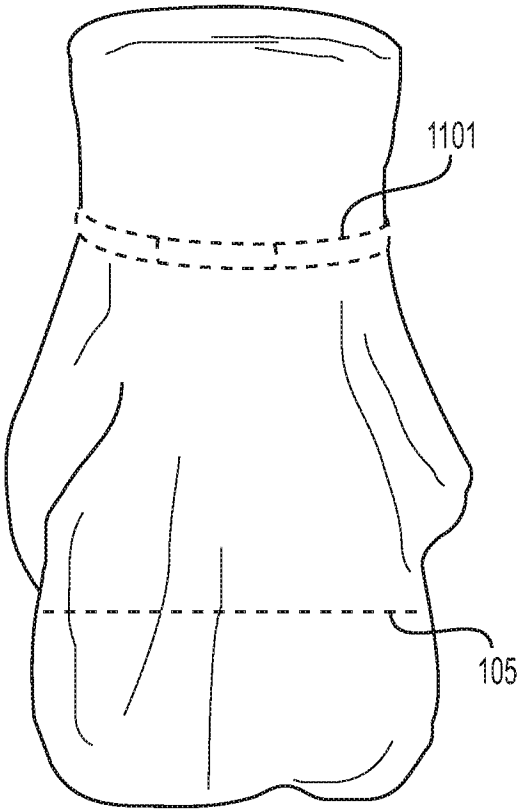
FIG. 11A shows a view of a configuration change of the present dress invention.
Figure 12C:
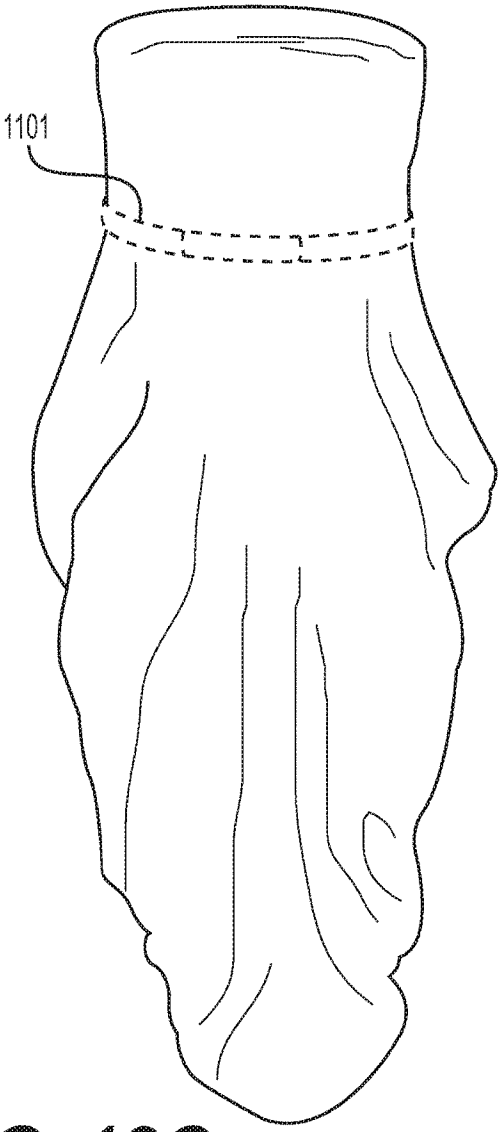
FIG. 12C shows a view of a configuration change of the present dress invention.
Figure 12B:
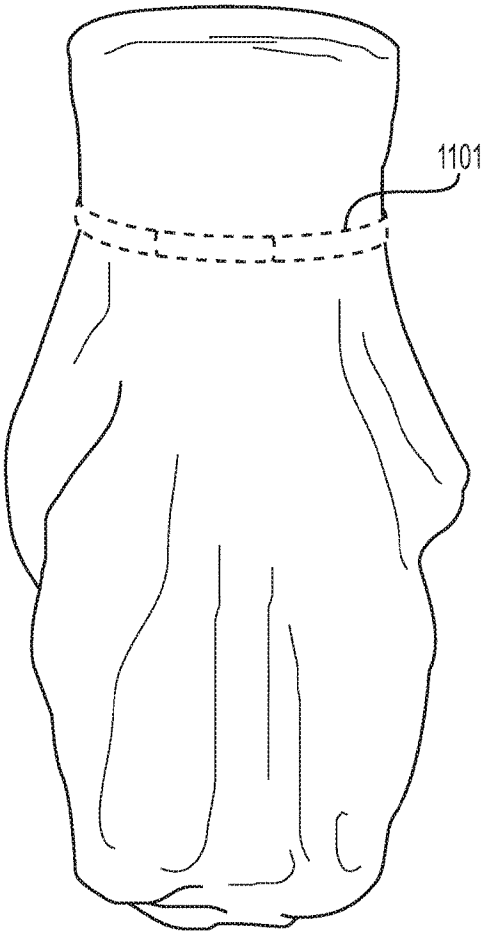
FIG. 12B shows a view of a configuration change of the present dress invention.
Figure 12A:
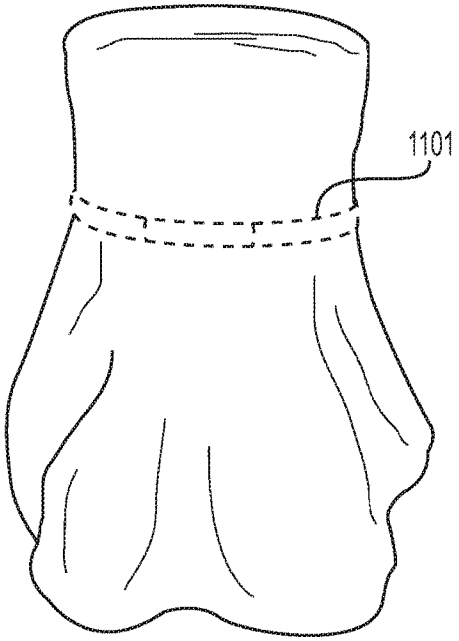
FIG. 12A shows a view of a configuration change of the present dress invention.

FIGS. 9A-9D shows a conversion of the configuration of the garment shown in FIG. 9A to a full-length, off-the shoulder garment. The upper sleeve portion 701 is drawn down and away from the user's shoulder, allowing the user to then place their arm outside of the garment with the upper sleeve portion 701 now disposed under the user's arm. The hemline 105 is drawn downward, and the sleeve 104 are inverted into the garment and hidden from view. The final garment configuration is shown in FIG. 9D. As with other configurations, the garment as shown in FIG. 9D can be converted in length as shown in FIGS. 10A, 10B, and 10C. The same is true with the addition of a belt 1101 or similar accessory (not claimed as a part of the present invention and shown in dotted lines in FIGS. 11A-11C, which show the modifications of lengths of the garment in 10C and further as shown in FIGS. 12A, 12B, and 12C.

Figure 13D:
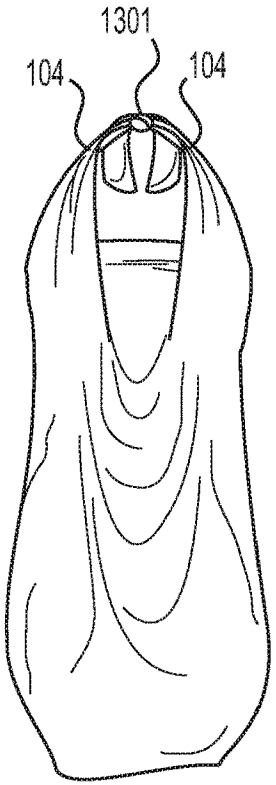
FIG. 13D shows a view of a configuration change of the present dress invention.
Figure 13C:
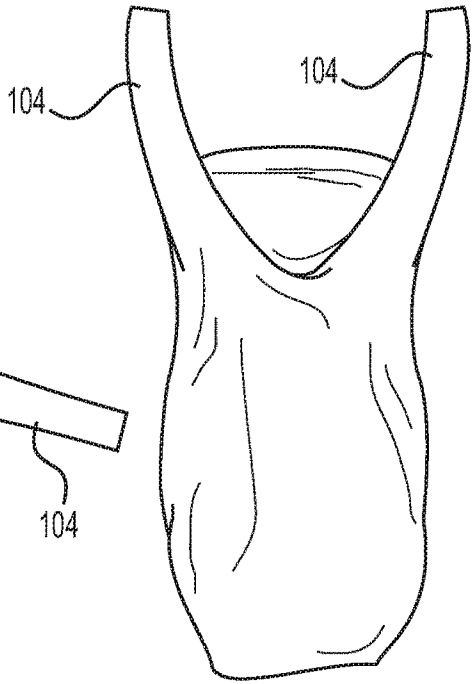
FIG. 13C shows a view of a configuration change of the present dress invention.
Figure 13B:
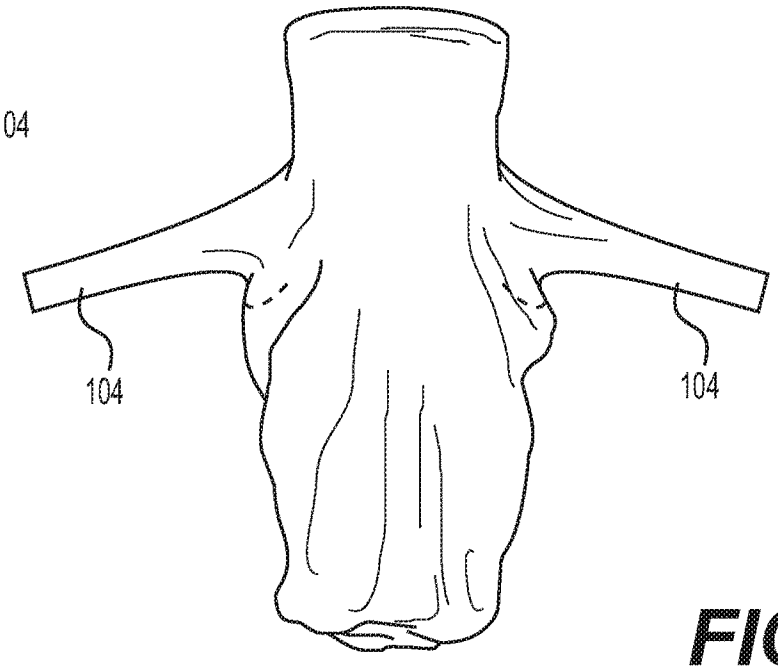
FIG. 13B shows a view of a configuration change of the present dress invention.
Figure 13A:
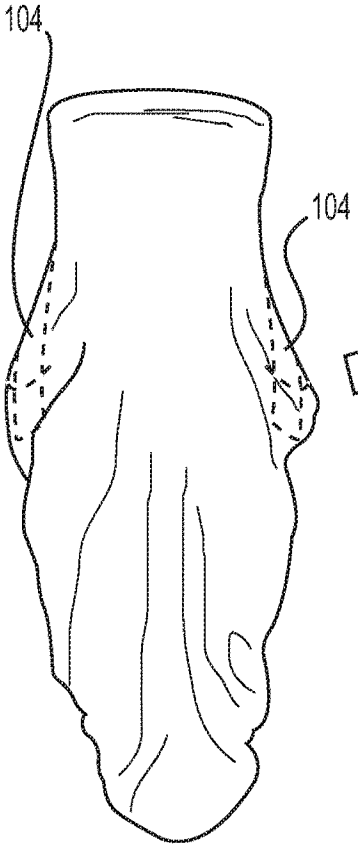
FIG. 13A shows a view of a configuration change of the present dress invention.
Figure 14C:
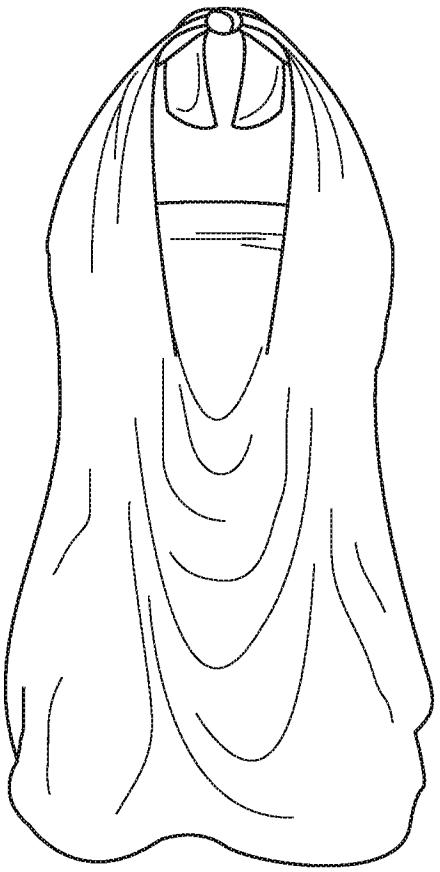
FIG. 14C shows a view of a configuration change of the present dress invention.
Figure 14B:
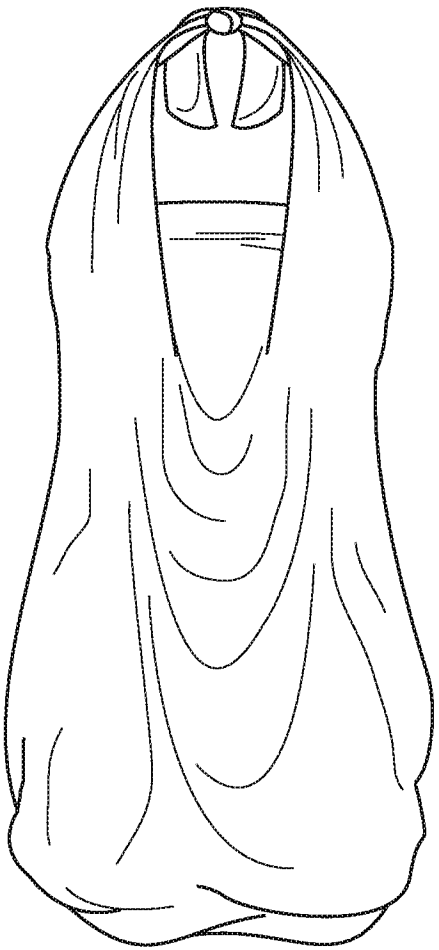
FIG. 14B shows a view of a configuration change of the present dress invention.
Figure 14A:
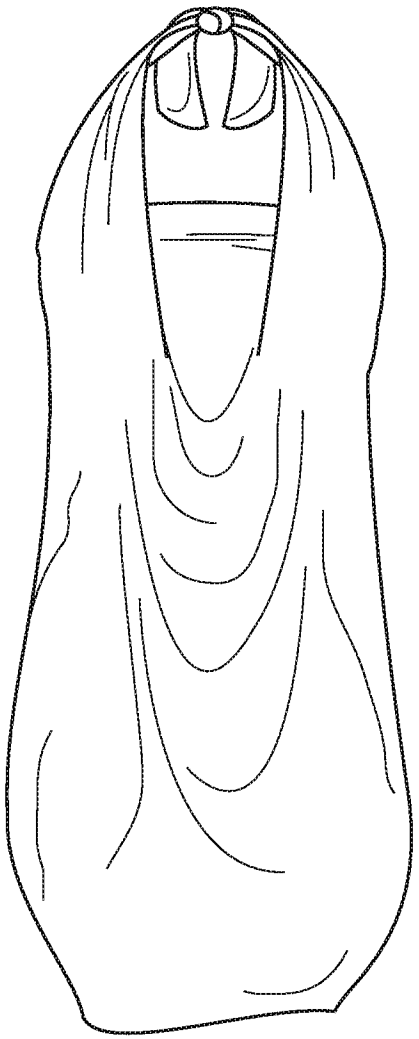
FIG. 14A shows a view of a configuration change of the present dress invention.

The garment configuration shown in FIG. 13A may be further changed as shown in FIGS. 13B-13D. The garment as configured in FIG. 13A is reconfigured by pulling the sleeves 104 out of the garment (FIG. 13B), raising the sleeves 104 upwards (FIG. 13C), and then tying the sleeves 104 with a knot 1301 behind the user's neck as shown in FIG. 13D. It will be understood that a variety of knots 1301 that are well known, including decorative, may be used to achieve this garment configuration without deviating from the spirit and scope of the invention. It will also be understood that mechanical clasping and/or holding means, including decorative, may be utilized to connect the sleeves 104 behind a user's neck. The mechanical means may be chosen from any number of possible devices, including clasps, ties, elastic ties and loops, or other means. As with other configurations, the garment length may be modified as shown in FIGS. 14A-14C.

Figure 15A:
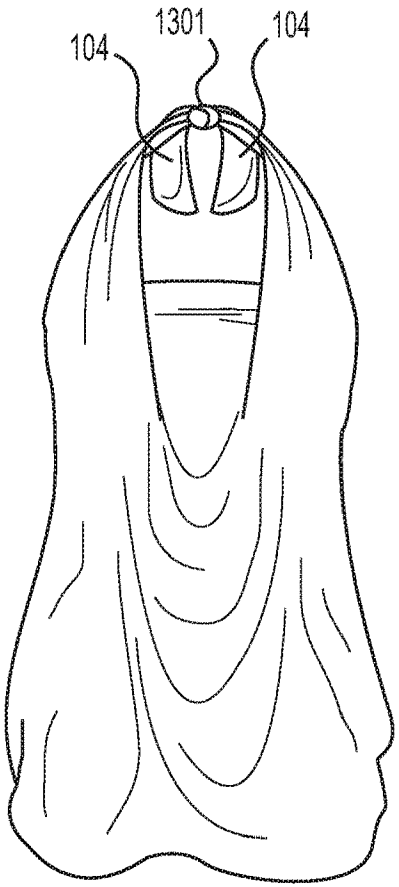
FIG. 15A shows a view of a configuration change of the present dress invention.
Figure 15B:
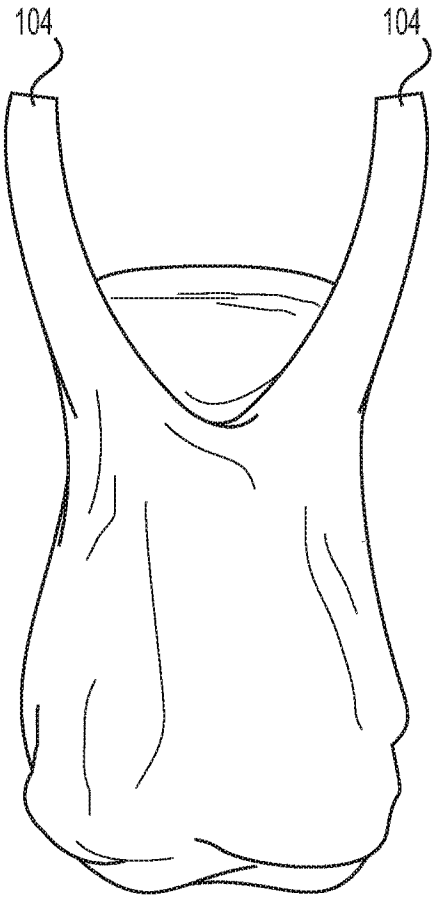
FIG. 15B shows a view of a configuration change of the present dress invention.
Figure 15C:
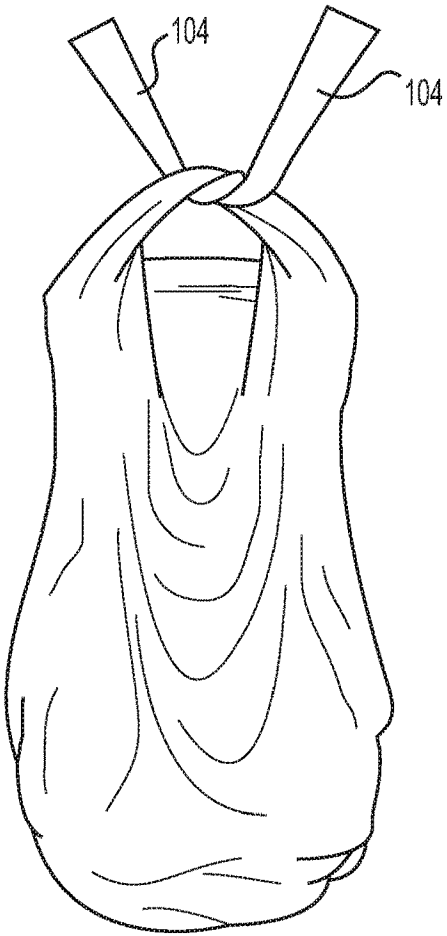
FIG. 15C shows a view of a configuration change of the present dress invention.
Figure 15D:
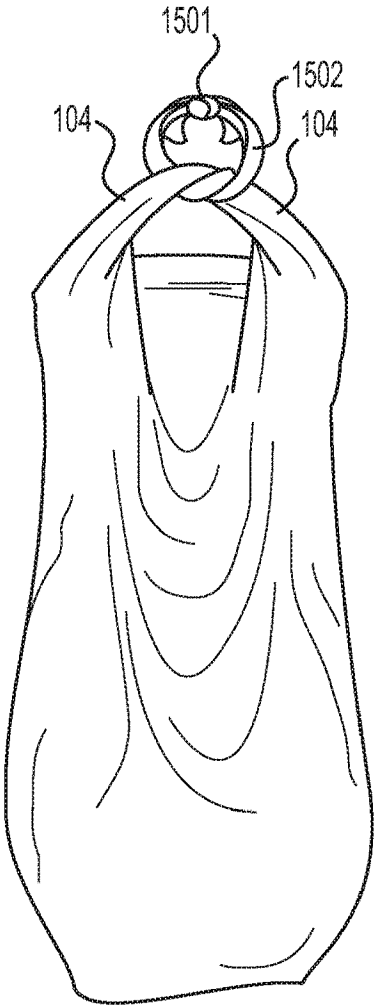
FIG. 15D shows a view of a configuration change of the present dress invention.

The garment as shown in FIG. 15A may be reconfigured as shown in FIGS. 15B-15D. The knot 1301 tied in the sleeves 104 is untied, and the sleeves 104 which are now loose (FIG. 15B) are looped around one another (15C), then passed around a user's neck and tied, resulting in a loop 1502 and knot 1501 holding the garment in place as shown in FIG. 15D. As in other configurations, the knot 1501 may be tied in numerous ways, and the sleeves 104 being connected behind a user's neck using mechanical means as described above, without deviating from the scope of the invention.

Figure 16D:
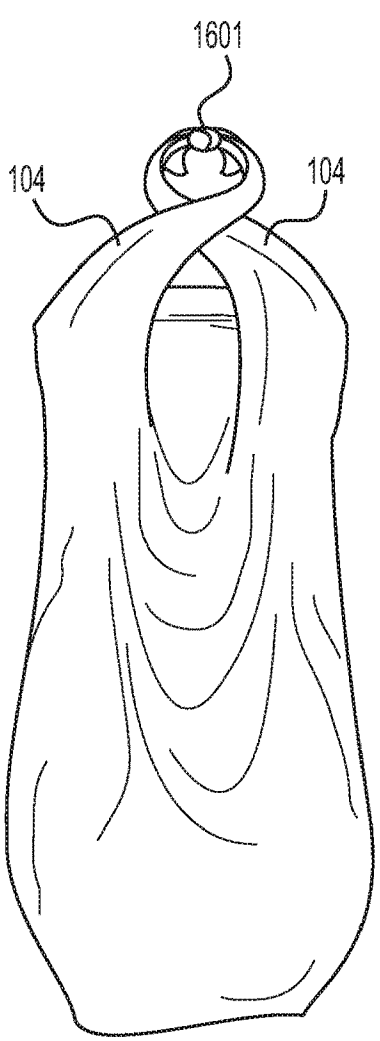
FIG. 16D shows a view of a configuration change of the present dress invention.
Figure 16C:
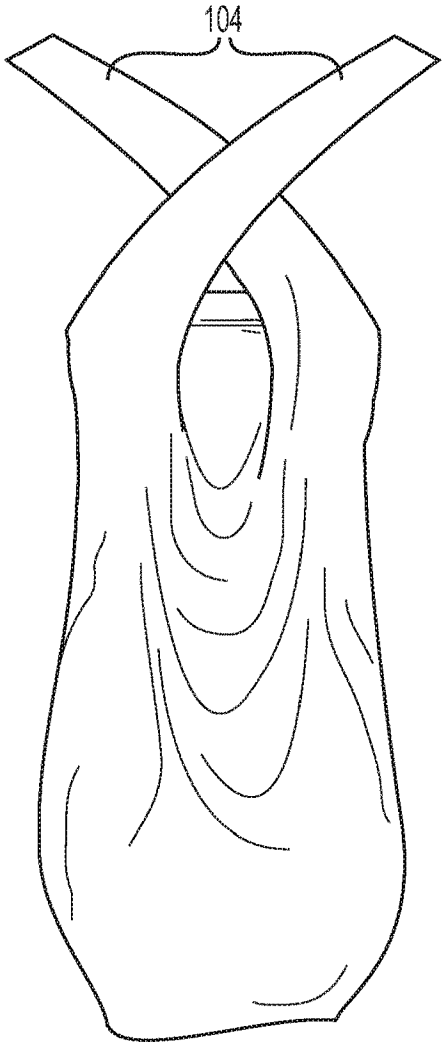
FIG. 16C shows a view of a configuration change of the present dress invention.
Figure 16B:
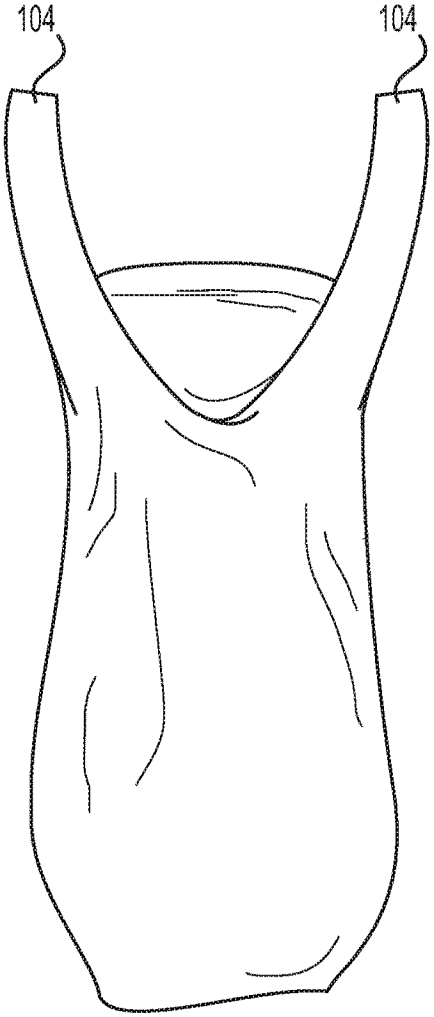
FIG. 16B shows a view of a configuration change of the present dress invention.
Figure 16A:
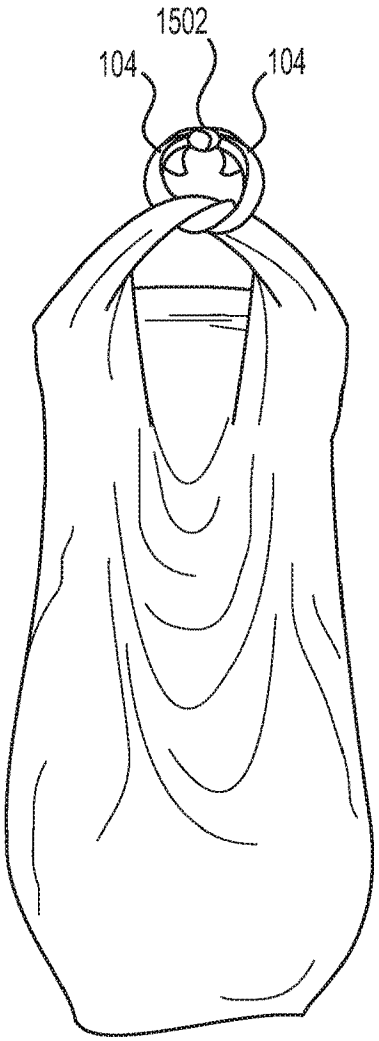
FIG. 16A shows a view of a configuration change of the present dress invention.
Figure 17C:
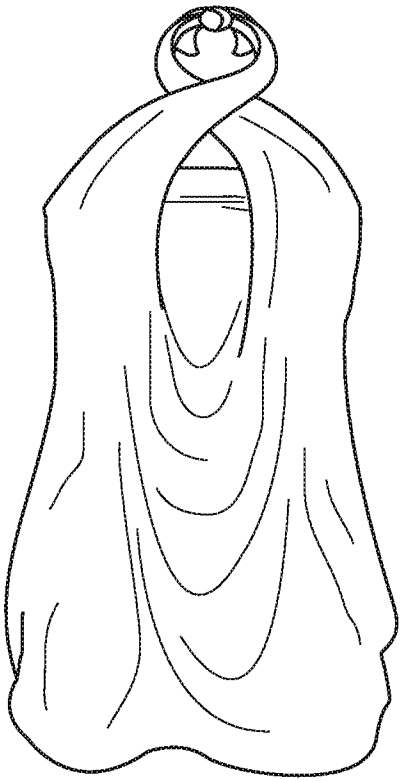
FIG. 17C shows a view of a configuration change of the present dress invention.
Figure 17B:
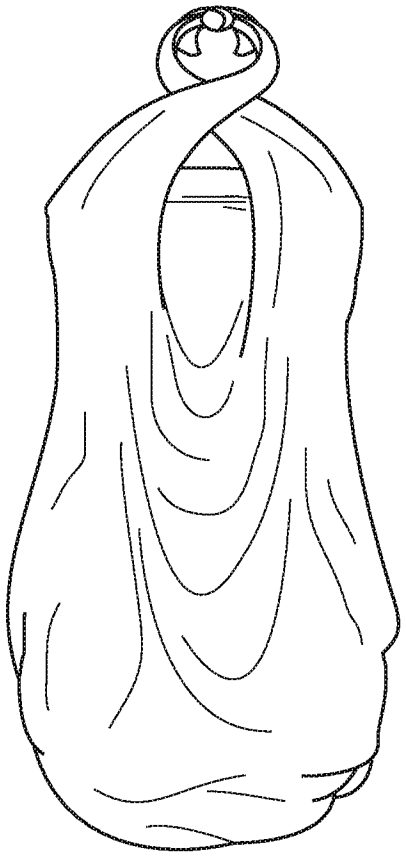
FIG. 17B shows a view of a configuration change of the present dress invention.
Figure 17A:
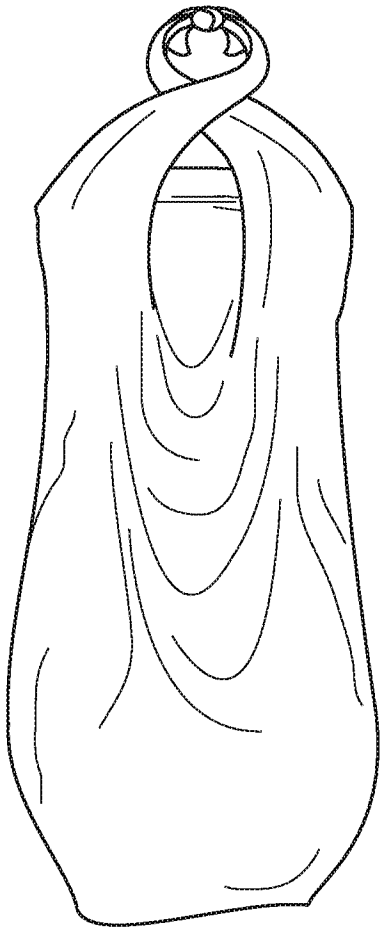
FIG. 17A shows a view of a configuration change of the present dress invention.
Figures 18A, 18B, 18C, 18D:
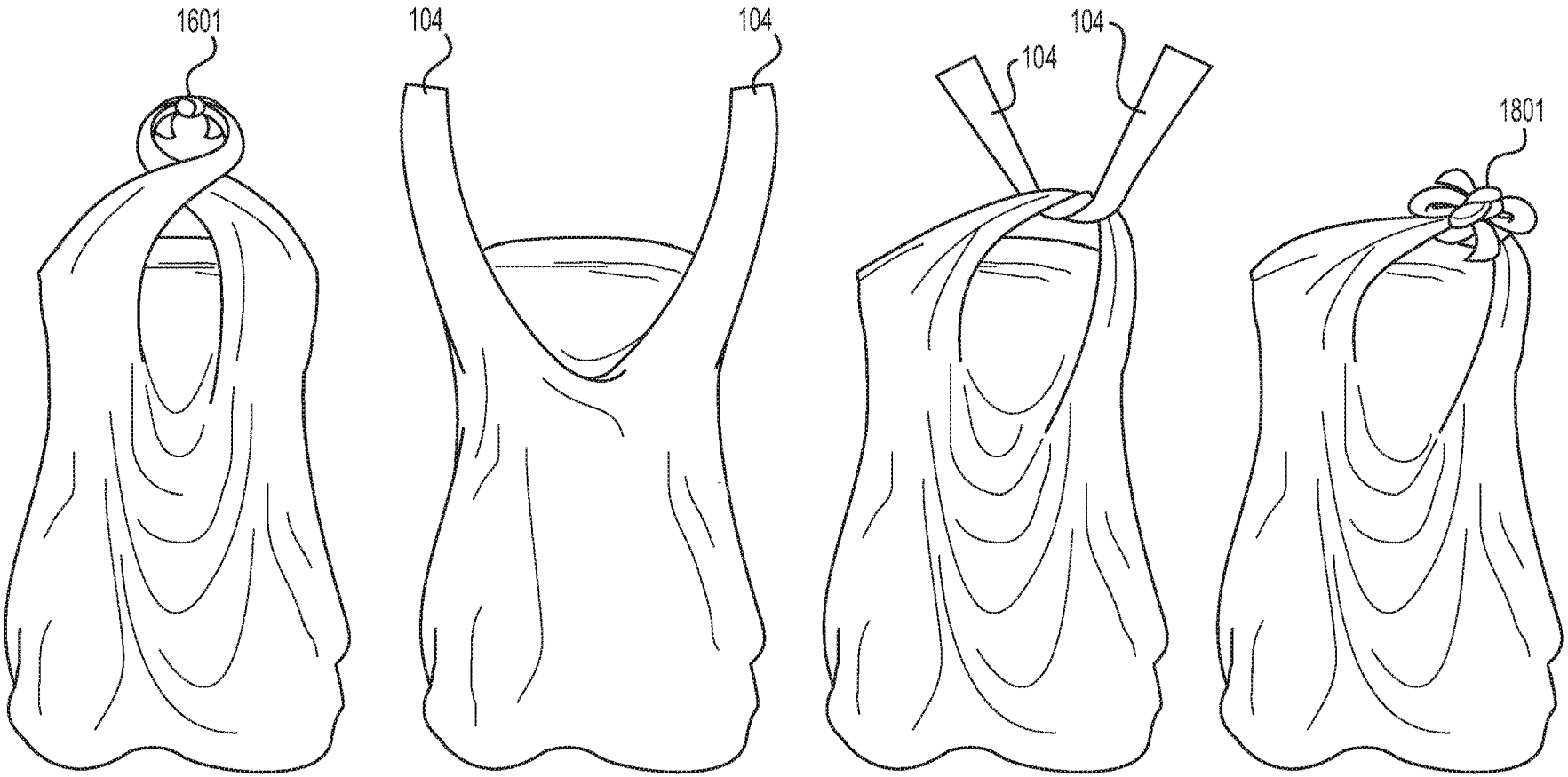
FIG. 18A shows a view of a configuration change of the present dress invention.
FIG. 18B shows a view of a configuration change of the present dress invention.
FIG. 18C shows a view of a configuration change of the present dress invention.
FIG. 18D shows a view of a configuration change of the present dress invention.

A further, similar configuration to that shown in FIG. 15D is shown in FIG. 16A, wherein the loose sleeves 104 (16B) are overlapped as shown in FIG. 16C, then tied in a knot 1601 behind the user's neck in the same or similar manner as that shown in FIG. 16D. As with other configurations, the configuration shown in FIG. 16D may be modified by modifying the length of the garment as shown in FIGS. 17A-17C.

Figure 19C:
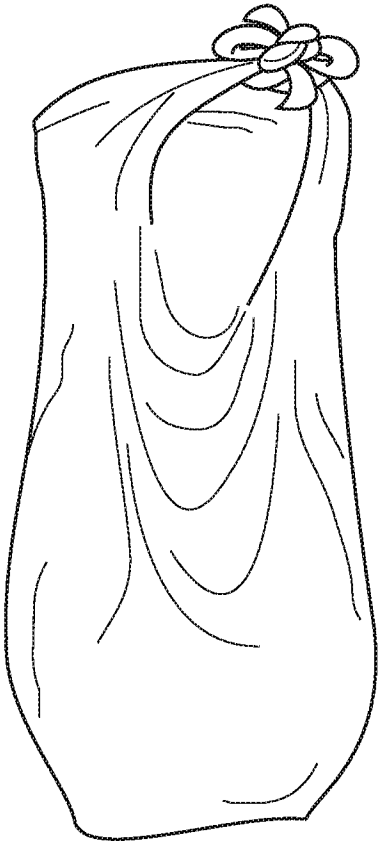
FIG. 19C shows a view of a configuration change of the present dress invention.
Figure 19B:
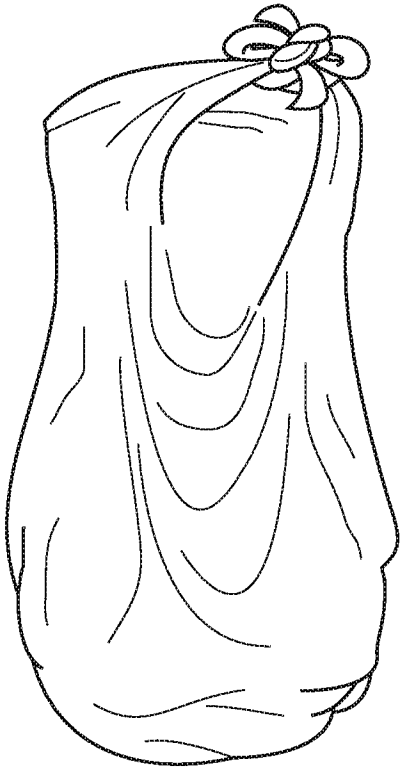
FIG. 19B shows a view of a configuration change of the present dress invention.
Figure 19A:
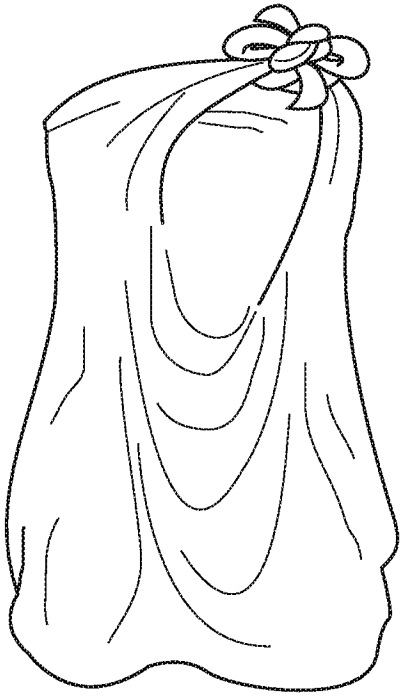
FIG. 19A shows a view of a configuration change of the present dress invention.

FIGS. 18A-18D shows a conversion of the garment to an off-the-shoulder configuration. The loose sleeves 104 are tied in front of a user's torso with a knot 1801 positioned on the upper torso of a user so that the garment leaves the user's shoulders bare and is positioned entirely under the arms of the user. The final configuration shown in FIG. 18D may be modified in length as shown in FIGS. 19A-19C.

Figures 20A, 20B, 20C, 20D:
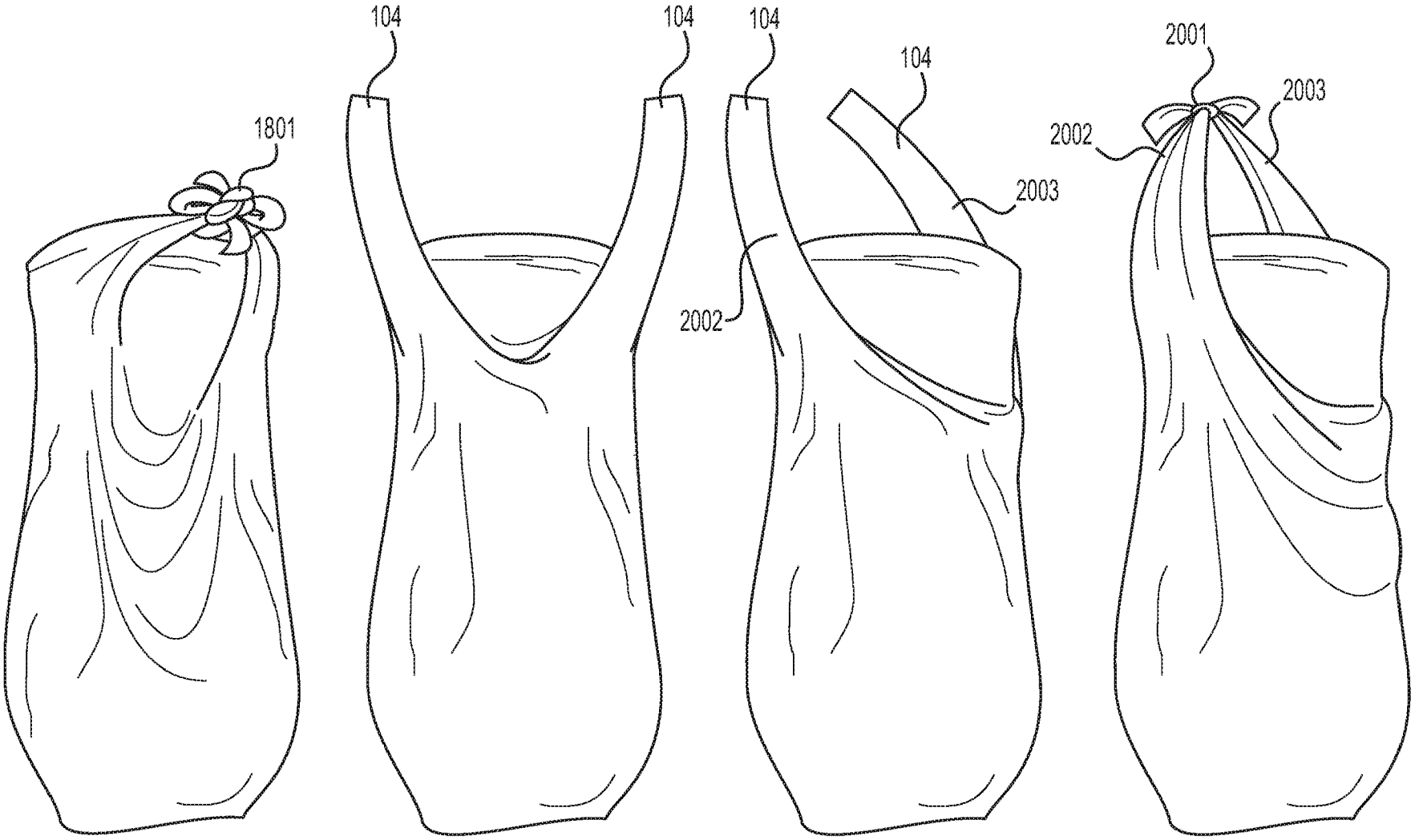
FIG. 20A shows a view of a configuration change of the present dress invention.
FIG. 20B shows a view of a configuration change of the present dress invention.
FIG. 20C shows a view of a configuration change of the present dress invention.
FIG. 20D shows a view of a configuration change of the present dress invention.
Figure 21C:
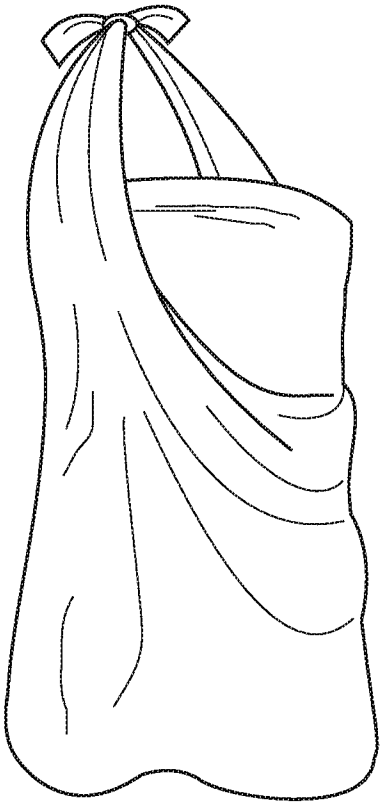
FIG. 21C shows a view of a configuration change of the present dress invention.
Figure 21B:
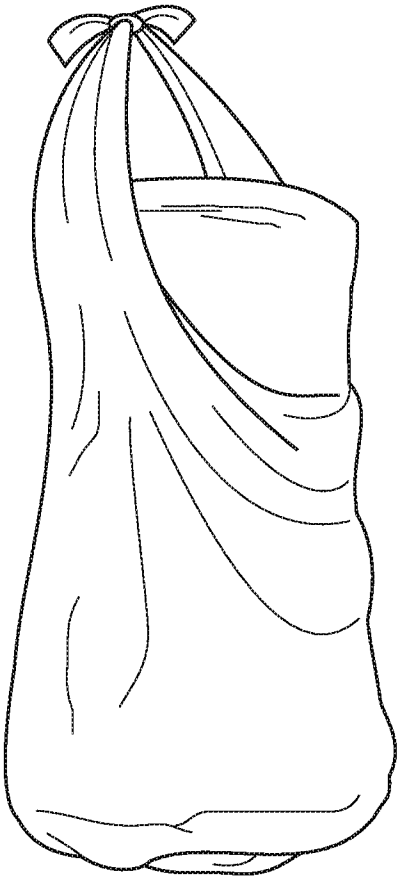
FIG. 21B shows a view of a configuration change of the present dress invention.
Figure 21A:
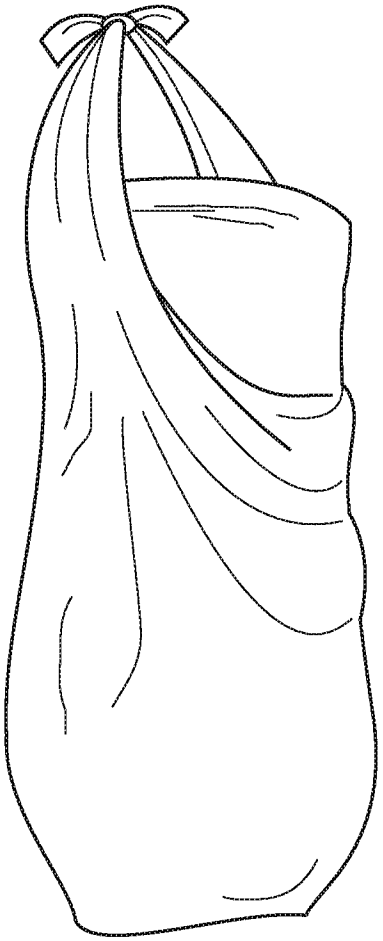
FIG. 21A shows a view of a configuration change of the present dress invention.

FIGS. 20A-20D shows a conversion of the garment to having a configuration with the loose sleeves 104 (FIG. 20B) being configured with one sleeve 2002 being placed up and over a user's shoulder, and one sleeve 2003 passing under a user's arm and then up a user's back (FIG. 20C) such that sleeve 2002 and sleeve 2003 can be fastened with a knot 2001 over the user's shoulder (FIG. 20D). As with other configurations, it will be understood that the knot 2001 may by modified or replaced by mechanical means and the sleeves 104 fastening over either of the user's shoulders. The length of this configuration may be modified as shown in FIGS. 21A-21C.

Figures 22A, 22B, 22C, 22D:
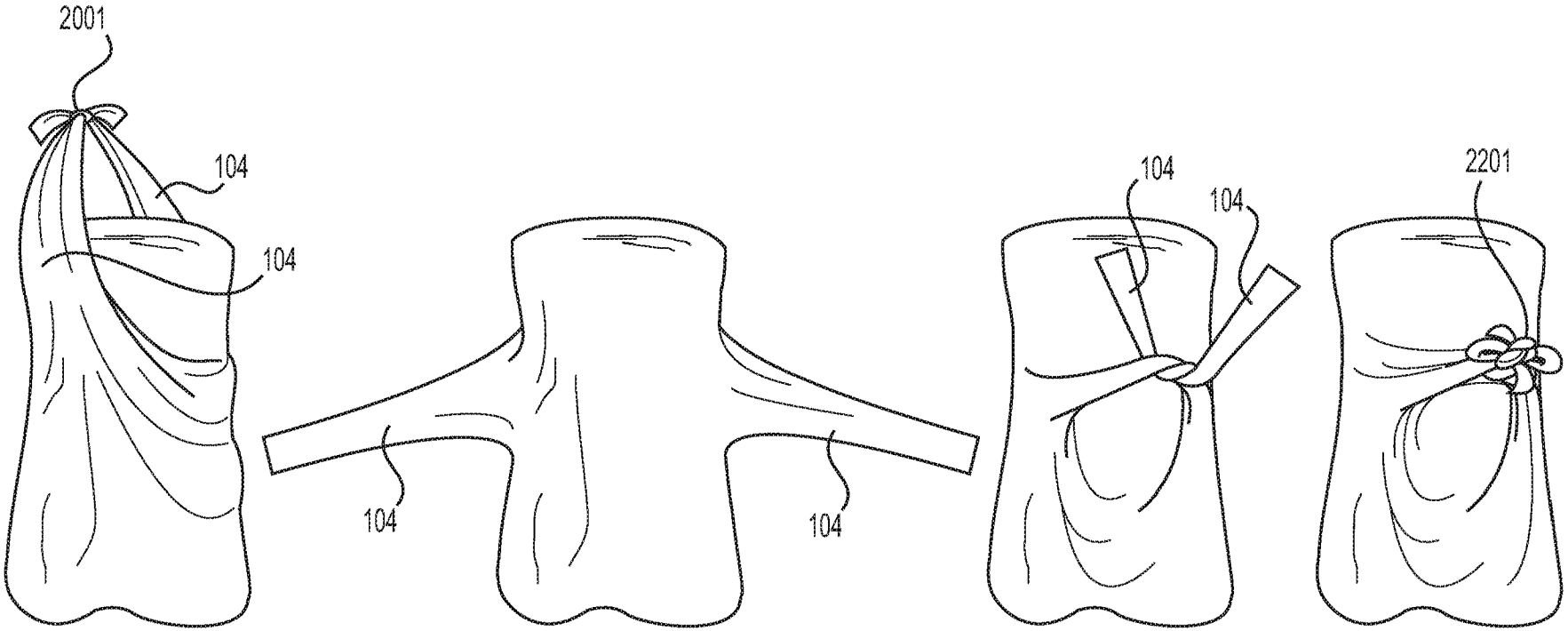
FIG. 22A shows a view of a configuration change of the present dress invention.
FIG. 22B shows a view of a configuration change of the present dress invention.
FIG. 22C shows a view of a configuration change of the present dress invention.
FIG. 22D shows a view of a configuration change of the present dress invention.
Figures 23A, 23B, 23C, 23D:
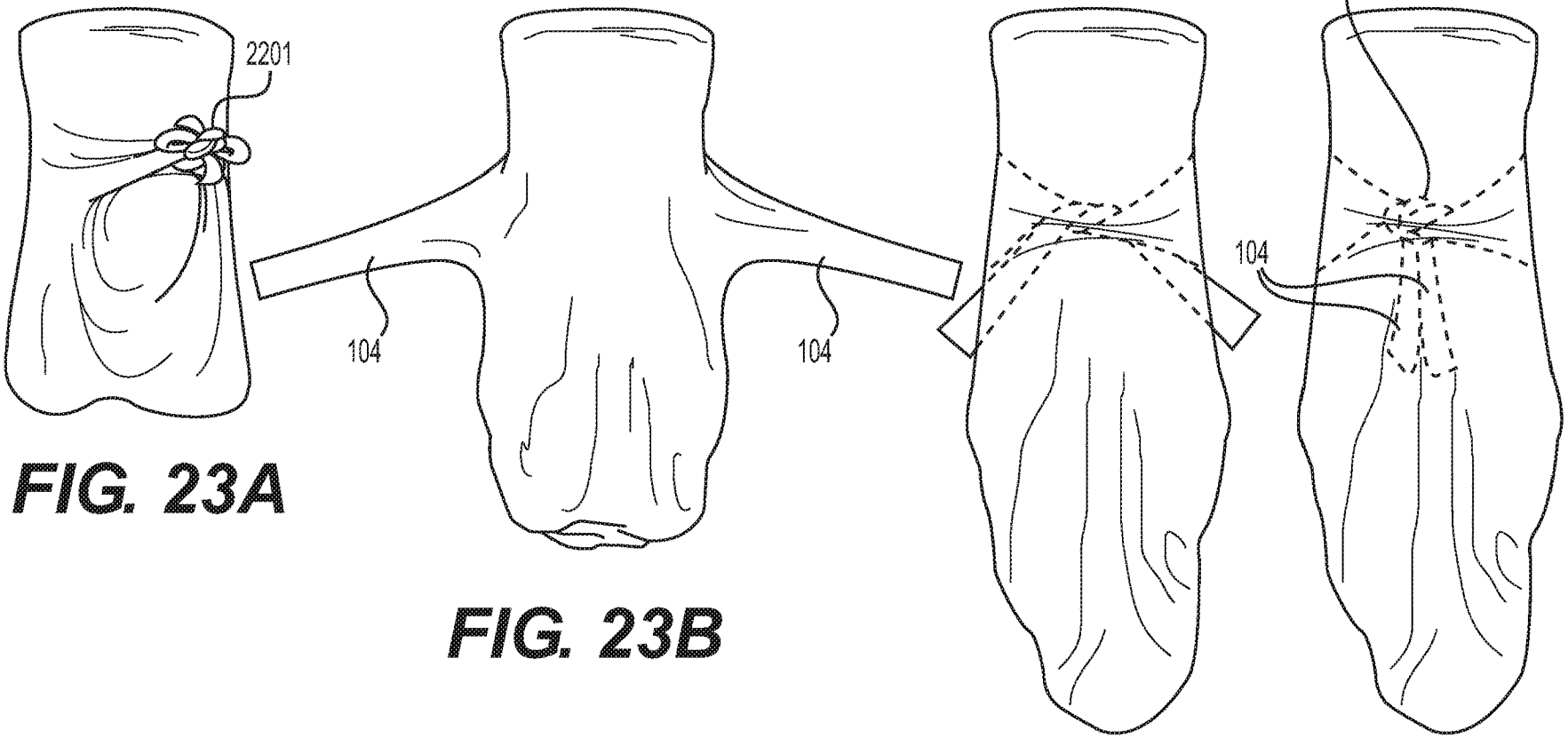
FIG. 23A shows a view of a configuration change of the present dress invention.
FIG. 23B shows a view of a configuration change of the present dress invention.
FIG. 23C shows a view of a configuration change of the present dress invention.
FIG. 23D shows a view of a configuration change of the present dress invention.
Figure 24C:
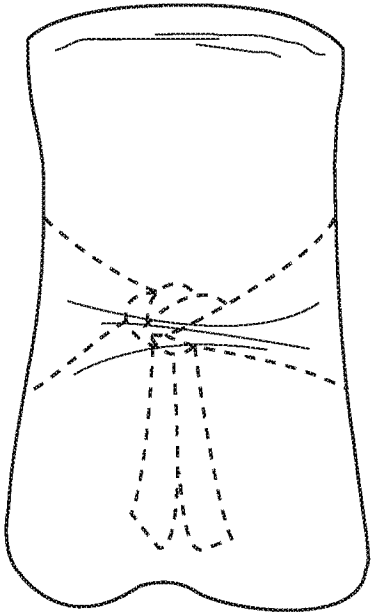
FIG. 24C shows a view of a configuration change of the present dress invention.
Figure 24B:
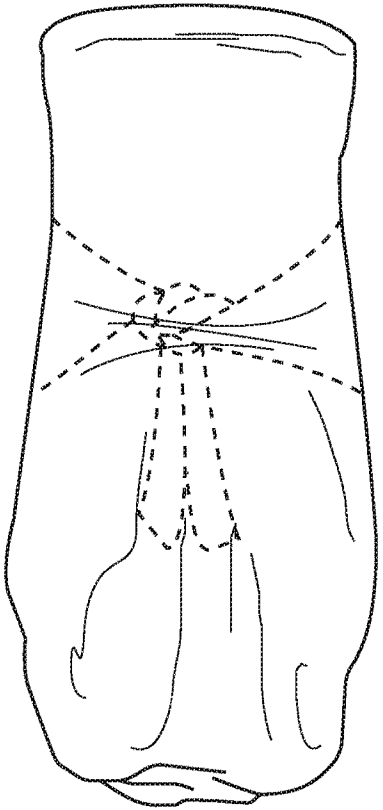
FIG. 24B shows a view of a configuration change of the present dress invention.
Figure 24A:
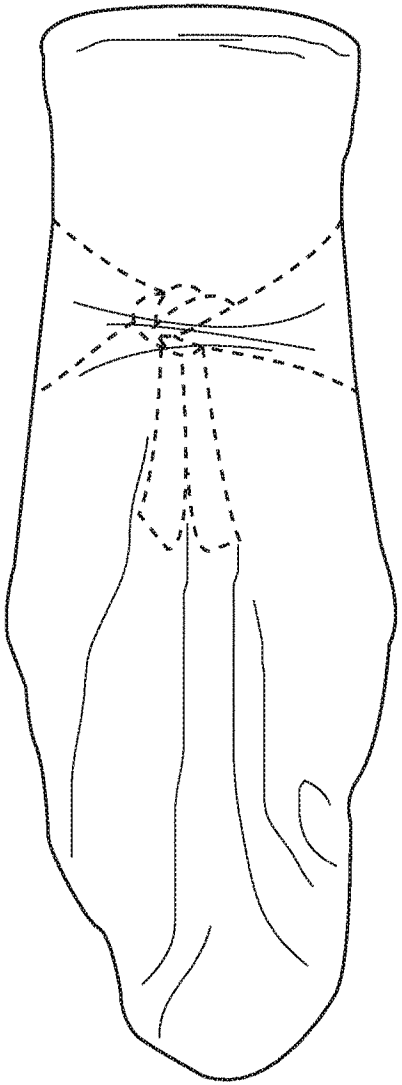
FIG. 24A shows a view of a configuration change of the present dress invention.

A further configuration may be achieved as shown in FIGS. 22A-22D. The sleeves 104 are untied (FIG. 22B), wrapped around a user (FIG. 22C), and tied with a knot 2201 (FIG. 22D). The length of this configuration may be changed, and the sleeves 104 passed behind a user's body to tie with a knot 2301 in the back of the user as shown in FIGS. 23A-23D, as well as having the length modified as shown in FIGS. 24A-24C.

Figures 25A, 25B, 25C, 25D:
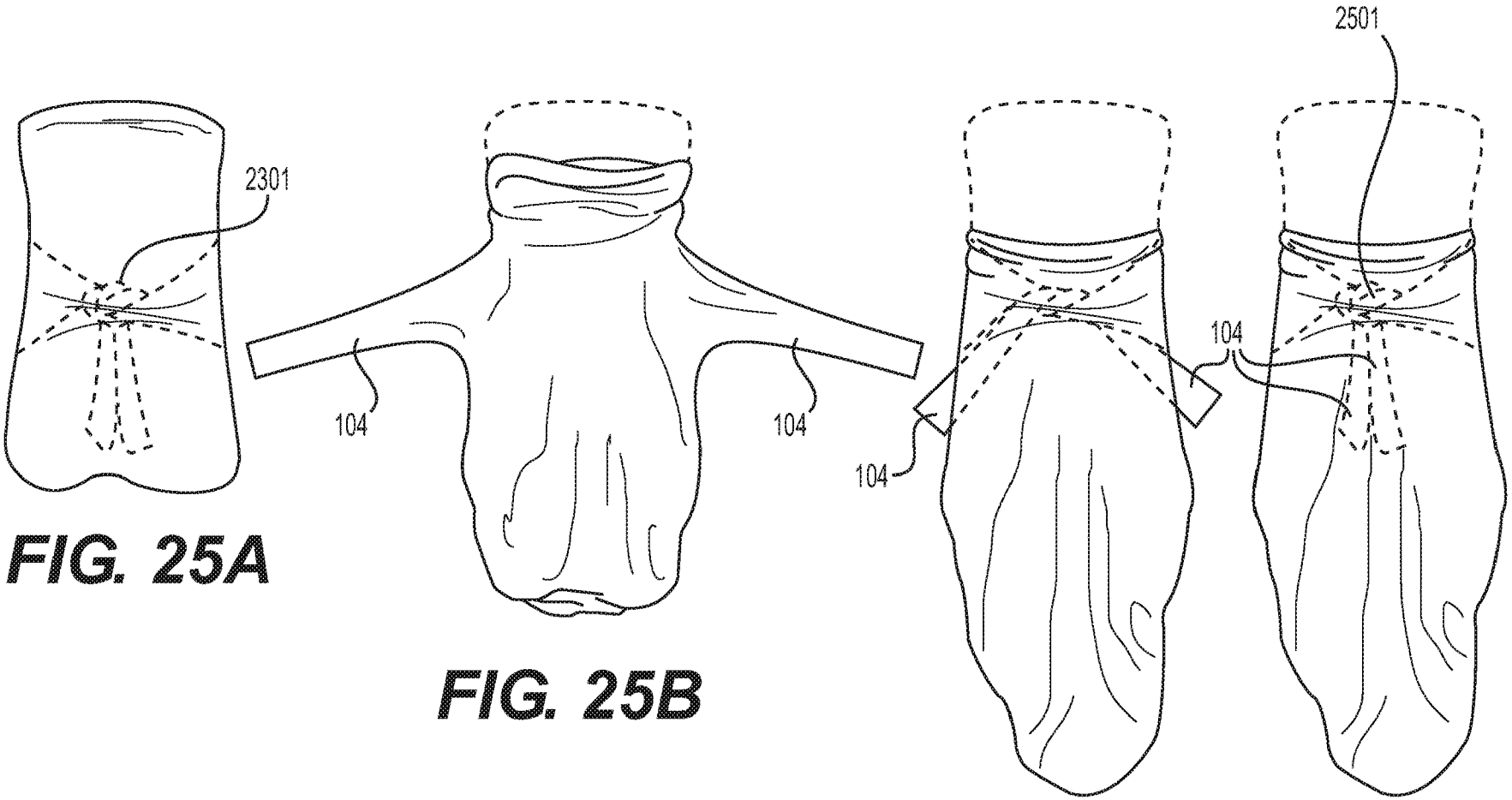
FIG. 25A shows a view of a configuration change of the present dress invention.
FIG. 25B shows a view of a configuration change of the present dress invention.
FIG. 25C shows a view of a configuration change of the present dress invention.
FIG. 25D shows a view of a configuration change of the present dress invention.

A further configuration may be obtained wherein the garment is worn as a skirt of varying length around a user's waist as shown in FIGS. 25A-25D, but fastened with the sleeves 104 tied with a knot 2501 as in the configuration shown in FIGS. 25C and 25D.

It will be understood that the configurations and modifications between configurations as described herein are examples. A user may reconfigure the garment without necessarily having to move through intermediary steps as described herein. It will also be understood that various textile and other materials may be used in the garment, and it is contemplated that the garment may incorporate stretchable/flexible fabrics, elastics, a combination of the two, or other configurations that allow for the garment configurations as described herein. As such, the examples as shown herein should not be understood to be limiting.

What is claimed is:

1. A method comprising:

providing a reconfigurable garment to be worn on a body of a wearer, the reconfigurable garment comprising a first area of elastic fabric configured to stretch and contract and a second area of the elastic fabric configured to stretch and contract, the first area of fabric and the second area of fabric being coupled together along a perimeter of each of the first area of fabric and the second area of fabric to define a shape of the reconfigurable garment, wherein the perimeter of each of the first area of fabric and the second area of fabric is configured according to a pattern comprising:

a body portion defining a central area;

a pair of sleeve portions comprising a right sleeve portion extending laterally from a right side of the body portion and a left sleeve portion extending laterally from a left side of the body portion;

a neck portion extending upward from the body portion and being oriented above the pair of sleeve portions, the neck portion comprising an upper length defining a neckline;

one or more shoulder portions extending between an upper portion of the pair of sleeve portions and a lower portion of the neck portion; and a skirt portion extending downward from the body portion and being oriented below the pair of sleeve portions, the skirt portion comprising a lower length defining a hemline;

selectively configuring the reconfigurable garment into at least one configuration in a plurality of separate configurations by stretching and inserting at least one of said portions of the reconfigurable garment into one or more other said portions of the reconfigurable garment, wherein the at least one of said portions of the reconfigurable garment is retained in place by the one or more other said portions of the reconfigurable garment when the reconfigurable garment is selectively configured into the at least one configuration in the plurality of separate configurations by the elasticity and contraction of the first area of elastic fabric and the second area of the elastic fabric when worn by the wearer.

2. The method of claim 1 further comprising selectively configuring the reconfigurable garment into a first configuration in the plurality of separate configurations by extending the skirt portion, the pair of sleeve portions and the neck portion to a full length of the reconfigurable garment.

3. The method of claim 1 further comprising selectively configuring the reconfigurable garment into a second configuration in the plurality of separate configurations by inserting the neck portion inside the body portion, wherein the elasticity and contraction of the neck portion is configured to retain the body portion in the second configuration when worn by the wearer.

4. The method of claim 1 further comprising selectively configuring the reconfigurable garment into a third configuration in the plurality of separate configurations by inserting the skirt portion inside itself such that the hemline is selectively positioned below the wearer's knees, wherein the elasticity and contraction of the skirt portion is configured to retain the skirt portion in the third configuration when worn by the wearer.

5. The method of claim 1 further comprising selectively configuring the reconfigurable garment into a fourth configuration in the plurality of separate configurations by inserting the skirt portion inside itself such that the hemline is selectively positioned above the wearer's knees, wherein the elasticity and contraction of the skirt portion is configured to retain the skirt portion in the fourth configuration when worn by the wearer.

6. The method of claim 1 further comprising selectively configuring the reconfigurable garment into a fifth configuration in the plurality of separate configurations by inserting the skirt portion inside the body portion such that the hemline is selectively positioned above the wearer's hips, wherein the elasticity and contraction of the body portion is configured to retain the skirt portion in the fifth configuration when worn by the wearer.

7. The method of claim 1 further comprising selectively configuring the reconfigurable garment into a sixth configuration in the plurality of separate configurations by inserting the neck portion inside the body portion such that the neckline is disposed on the wearer's torso and below the wearer's shoulders, wherein the elasticity and contraction of the body portion is configured to retain the neck portion in the sixth configuration when worn by the wearer.

8. The method of claim 1 further comprising selectively configuring the reconfigurable garment into a seventh configuration in the plurality of separate configurations by tying the pair of sleeve portions over one or both of the wearer's shoulders.

9. The method of claim 1 further comprising selectively configuring the reconfigurable garment into a eighth configuration in the plurality of separate configurations by tying the pair of sleeve portions behind the wearer's neck.

10. The method of claim 1 further comprising selectively configuring the reconfigurable garment into a ninth configuration in the plurality of separate configurations by tying the pair of sleeve portions behind the wearer's waist.

* * * * *